US008723687B2

(12) United States Patent
Thomas

(10) Patent No.: US 8,723,687 B2
(45) Date of Patent: May 13, 2014

(54) ADVANCED VEHICLE TRAFFIC MANAGEMENT AND CONTROL

(76) Inventor: Alex Thomas, Sharjah (AE)

( * ) Notice: Subject to any disclaimer, the term of this patent is extended or adjusted under 35 U.S.C. 154(b) by 160 days.

(21) Appl. No.: 13/330,659

(22) Filed: Dec. 19, 2011

(65) Prior Publication Data

US 2012/0249343 A1 Oct. 4, 2012

Related U.S. Application Data

(60) Provisional application No. 61/469,913, filed on Mar. 31, 2011.

(51) Int. Cl.
*G08G 1/09* (2006.01)

(52) U.S. Cl.
USPC ..... 340/905; 340/932; 340/921

(58) Field of Classification Search
USPC ..... 340/905, 901–903, 907, 928, 932, 988, 340/937, 933, 938, 916, 921
See application file for complete search history.

(56) References Cited

U.S. PATENT DOCUMENTS

| | | | | |
|---|---|---|---|---|
| 3,784,970 | A | 1/1974 | Simpkin | |
| 5,428,544 | A | 6/1995 | Shyu | |
| 5,675,518 | A * | 10/1997 | Kuroda et al. | 702/97 |
| 5,864,305 | A | 1/1999 | Rosenquist | |
| 6,151,550 | A * | 11/2000 | Nakatani | 701/117 |
| 6,336,075 | B1 | 1/2002 | Park et al. | |
| 6,388,578 | B1 * | 5/2002 | Fagan et al. | 340/901 |
| 6,587,788 | B1 * | 7/2003 | Green | 701/484 |
| 6,785,551 | B1 | 8/2004 | Richard | |
| 6,898,517 | B1 | 5/2005 | Froeberg | |
| 6,919,823 | B1 * | 7/2005 | Lock | 340/937 |
| 7,439,878 | B2 | 10/2008 | Kato et al. | |
| 7,831,380 | B2 * | 11/2010 | Chapman et al. | 701/118 |
| 7,865,309 | B2 | 1/2011 | Taylor | |
| 7,917,263 | B2 * | 3/2011 | Miura | 701/45 |
| 2002/0121989 | A1 | 9/2002 | Burns | |
| 2007/0001830 | A1 * | 1/2007 | Dagci et al. | 340/438 |
| 2007/0046457 | A1 | 3/2007 | Suzuki et al. | |
| 2008/0120054 | A1 * | 5/2008 | Parks et al. | 702/92 |
| 2010/0169009 | A1 | 7/2010 | Breed et al. | |
| 2011/0032121 | A1 | 2/2011 | Beuvink | |

FOREIGN PATENT DOCUMENTS

| | | | |
|---|---|---|---|
| EP | 0773524 | A1 | 5/1997 |
| GB | 2431761 | A | 5/2007 |
| KR | 20040032413 | A | 4/2004 |

* cited by examiner

*Primary Examiner* — Daniel Previl
(74) *Attorney, Agent, or Firm* — McNeely, Hare & War LLP; James E. Mrose

(57) ABSTRACT

A system for intelligent transport communication includes at least one transmitter, and at least one in-vehicle mobile receiver for use within a mobile road vehicle. The transmitter broadcasts, by wireless communication, dedicated data for each of a plurality of heading directions of the mobile road vehicle, on a corresponding plurality of multiplexed channels. The receiver receives the dedicated data on one of the multiplexed channels that corresponds to an actual heading direction of the mobile road vehicle. A multiple-redundant vehicle heading direction identification system for use within the mobile road vehicle includes a GPS direction identification system, a multiple digital compass system that identifies a heading direction of the mobile road vehicle based on input from multiple digital compasses, and a central processing unit that selects the heading direction produced by the GPS direction identification system only when an output of the GPS direction identification system is healthy.

26 Claims, 11 Drawing Sheets

| sl# | DESCRIPTION | COMMUNICATION SEGMENT WITHIN ANGLES AS MEASURED FROM TN | | MULTIPLEXED BASE CODE FOR STATIONARY TRANSMITTER TO VEHICLE | ADDITIONAL FILTERING AVAILABLE FOR EACH DIRECTION ASSIGNED BY SATELLITE TRANSMITTER, FOR USE IN DENSE SIGNAL AREAS WHERE MORE THAN ONE INTERSECTION EXISTS WITHIN 350 METERS. UP TO 8 PARALLEL INTERSECTIONS CAN EXISTS WITHIN 350 METERS WITH THIS CONFIGURATION, | | | | | | | | PRIORITY FILTERING INSTRUCTION) | REMARKS |
|---|---|---|---|---|---|---|---|---|---|---|---|---|---|---|
| | | FROM | TO | | ADDL FILTERING 1 | ADDL FILTERING 2 | ADDL FILTERING 3 | ADDL FILTERING 4 | ADDL FILTERING 5 | ADDL FILTERING 6 | ADDL FILTERING 7 | ADDL FILTERING 8 | | |
| 1 | GENERAL COMMUNICATION | **0.00** | **360.00** | **DSCDMA0-0** | COMMUNICATION AVAILABLE TO ALL CARS IN RANGE OF SIGNAL | | | | | | | | | |
| 2 | CODE FOR VEHICLES TRAVELLING IN CS1 | 348.75 | 11.25 | **DSCDMA1-0** | DSCDMA1-1 | DSCDMA1-2 | DSCDMA1-3 | DSCDMA1-4 | DSCDMA1-5 | DSCDMA1-6 | DSCDMA1-7 | DSCDMA1-8 | **DSCDMA1-9** | |
| 3 | CODE FOR VEHICLES TRAVELLING IN CS2 | 11.25 | 33.75 | **DSCDMA2-0** | DSCDMA2-1 | DSCDMA2-2 | DSCDMA2-3 | DSCDMA2-4 | DSCDMA2-5 | DSCDMA2-6 | DSCDMA2-7 | DSCDMA2-8 | **DSCDMA2-9** | |
| 4 | CODE FOR VEHICLES TRAVELLING IN CS3 | 33.75 | 56.25 | **DSCDMA3-0** | DSCDMA3-1 | DSCDMA3-2 | DSCDMA3-3 | DSCDMA3-4 | DSCDMA3-5 | DSCDMA3-6 | DSCDMA3-7 | DSCDMA3-8 | **DSCDMA3-9** | |
| 5 | CODE FOR VEHICLES TRAVELLING IN CS4 | 56.25 | 78.75 | **DSCDMA4-0** | DSCDMA4-1 | DSCDMA4-2 | DSCDMA4-3 | DSCDMA4-4 | DSCDMA4-5 | DSCDMA4-6 | DSCDMA4-7 | DSCDMA4-8 | **DSCDMA4-9** | |
| 6 | CODE FOR VEHICLES TRAVELLING IN CS5 | 78.75 | 101.25 | **DSCDMA5-0** | DSCDMA5-1 | DSCDMA5-2 | DSCDMA5-3 | DSCDMA5-4 | DSCDMA5-5 | DSCDMA5-6 | DSCDMA5-7 | DSCDMA5-8 | **DSCDMA5-9** | |
| 7 | CODE FOR VEHICLES TRAVELLING IN CS6 | 101.25 | 123.75 | **DSCDMA6-0** | DSCDMA6-1 | DSCDMA6-2 | DSCDMA6-3 | DSCDMA6-4 | DSCDMA6-5 | DSCDMA6-6 | DSCDMA6-7 | DSCDMA6-8 | **DSCDMA6-9** | |
| 8 | CODE FOR VEHICLES TRAVELLING IN CS7 | 123.75 | 146.25 | **DSCDMA7-0** | DSCDMA7-1 | DSCDMA7-2 | DSCDMA7-3 | DSCDMA7-4 | DSCDMA7-5 | DSCDMA7-6 | DSCDMA7-7 | DSCDMA7-8 | **DSCDMA7-9** | |
| 9 | CODE FOR VEHICLES TRAVELLING IN CS8 | 146.25 | 168.75 | **DSCDMA8-0** | DSCDMA8-1 | DSCDMA8-2 | DSCDMA8-3 | DSCDMA8-4 | DSCDMA8-5 | DSCDMA8-6 | DSCDMA8-7 | DSCDMA8-8 | **DSCDMA8-9** | |
| 10 | CODE FOR VEHICLES TRAVELLING IN CS9 | 168.75 | 191.25 | **DSCDMA9-0** | DSCDMA9-1 | DSCDMA9-2 | DSCDMA9-3 | DSCDMA9-4 | DSCDMA9-5 | DSCDMA9-6 | DSCDMA9-7 | DSCDMA9-8 | **DSCDMA9-9** | |
| 11 | CODE FOR VEHICLES TRAVELLING IN CS10 | 191.25 | 213.75 | **DSCDMA10-0** | DSCDMA10-1 | DSCDMA10-2 | DSCDMA10-3 | DSCDMA10-4 | DSCDMA10-5 | DSCDMA10-6 | DSCDMA10-7 | DSCDMA10-8 | **DSCDMA10-9** | |
| 12 | CODE FOR VEHICLES TRAVELLING IN CS11 | 213.75 | 236.25 | **DSCDMA11-0** | DSCDMA11-1 | DSCDMA11-2 | DSCDMA11-3 | DSCDMA11-4 | DSCDMA11-5 | DSCDMA11-6 | DSCDMA11-7 | DSCDMA11-8 | **DSCDMA11-9** | |
| 13 | CODE FOR VEHICLES TRAVELLING IN CS12 | 236.25 | 258.75 | **DSCDMA12-0** | DSCDMA12-1 | DSCDMA12-2 | DSCDMA12-3 | DSCDMA12-4 | DSCDMA12-5 | DSCDMA12-6 | DSCDMA12-7 | DSCDMA12-8 | **DSCDMA12-9** | |
| 14 | CODE FOR VEHICLES TRAVELLING IN CS13 | 258.75 | 281.25 | **DSCDMA13-0** | DSCDMA13-1 | DSCDMA13-2 | DSCDMA13-3 | DSCDMA13-4 | DSCDMA13-5 | DSCDMA13-6 | DSCDMA13-7 | DSCDMA13-8 | **DSCDMA13-9** | |
| 15 | CODE FOR VEHICLES TRAVELLING IN CS14 | 281.25 | 303.75 | **DSCDMA14-0** | DSCDMA14-1 | DSCDMA14-2 | DSCDMA14-3 | DSCDMA14-4 | DSCDMA14-5 | DSCDMA14-6 | DSCDMA14-7 | DSCDMA14-8 | **DSCDMA14-9** | |
| 16 | CODE FOR VEHICLES TRAVELLING IN CS15 | 303.75 | 326.25 | **DSCDMA15-0** | DSCDMA15-1 | DSCDMA15-2 | DSCDMA15-3 | DSCDMA15-4 | DSCDMA15-5 | DSCDMA15-6 | DSCDMA15-7 | DSCDMA15-8 | **DSCDMA15-9** | |
| 17 | CODE FOR VEHICLES TRAVELLING IN CS16 | 326.25 | 348.75 | **DSCDMA16-0** | DSCDMA16-1 | DSCDMA16-2 | DSCDMA16-3 | DSCDMA16-4 | DSCDMA16-5 | DSCDMA16-6 | DSCDMA16-7 | DSCDMA16-8 | **DSCDMA16-9** | |

FIG 8

ADVANCED VEHICLE TRAFFIC MANAGEMENT AND CONTROL

CROSS-REFERENCE TO RELATED APPLICATION

This patent application claims the benefit of Alex Thomas, Provisional Application No. 61/469,913, filed Mar. 31, 2011, which is hereby incorporated herein in its entirety.

TECHNICAL FIELD

The invention relates to a system and method for implementation of advanced vehicle traffic management and control, and more particularly to a system having a transmitter and a mobile vehicular unit, communicating both general and direction-based data, specifically filtered for and relevant only to vehicle heading direction.

BACKGROUND

Vehicle traffic control has witnessed little advancement since its introduction in the 1920's. Certain attempts have been made to implement automated traffic control systems, however.

For example, Taylor, U.S. Pat. No. 7,865,309 discloses a system in which geographic coordinate data is used as a principal criterion for implementing wireless transmitted instructions and communications advising vehicles of an approaching emergency vehicle, the proximity of a hazardous condition, or other situations relevant to the intended recipient because of the recipient's location. This patent also describes intervention and control of a vehicle that comes into a predetermined location. The system uses transmitting units and receiving units, both of which can receive geographical positioning information and which may sound an appropriate advisory or warning based on their positions, heading, or speed. Geographic location of the intended recipient, or target, and its heading or speed, if desired, are used as a screen or filter for the delivery or the broadcast of an advisory.

Kato et al., U.S. Pat. No. 7,439,878 discloses a vehicle navigation system for use with a traffic information broadcast system. The broadcast system transmits traffic data relating to primary road segments in a local geographic area. A broadcast receiver receives the broadcast traffic data from the broadcast system and stores the received data. A communication transmitter, when activated, transmits a data request to the communication system. A communication receiver receives the local traffic data from the communication system in response to the data request while a processor displays traffic information on a display screen corresponding to the received broadcast traffic data and the received local traffic data.

Burns, U.S. Published Patent Application 2002/0121989 describes a system for providing personalized traffic alerts to a user by automatic processing of vehicle position and traffic alert conditions. The system employs at least one user portion and a server portion, wherein the server portion provides the user portion with traffic alert information. The user portion includes a receiver, a position locator, a processor, a memory storage area, and an output device. The processor calculates the vehicle trajectory and in addition, the processor can predict the vehicle route based on the calculated vehicle trajectory, and historical routes in the memory storage area. The processor also correlates relevant traffic alerts by comparing the traffic alert information with the calculated vehicle trajectory or the predicted vehicle route.

Park et al., U.S. Pat. No. 6,336,075 discloses a system for guiding a vehicle, in which a transmission signal of a position transmitting device (with the transmitters being installed at key points on a roadside) is received by a position receiving device mounted in the vehicle. The system includes units for coding position information on the road where the position transmitting device is installed, along with traffic information such as warning information with respect to the road. The units store this information, modulate the information and continuously transmit the coded information to the vehicle.

Improved traffic monitoring and control and implementation of a state-of-the-art traffic management and control system could reduce traffic accidents and traffic-related deaths and improve traffic management.

SUMMARY

One aspect of the invention features a system for intelligent transport communication that includes at least one transmitter, and at least one in-vehicle mobile receiver for use within a mobile road vehicle. The transmitter is programmed to broadcast, by wireless communication, dedicated data for each of a plurality of heading directions of the mobile road vehicle, on a corresponding plurality of multiplexed channels. The receiver is programmed to receive the dedicated data on one of the multiplexed channels that corresponds to an actual heading direction of the mobile road vehicle.

In certain embodiments, the transmitter communicates with the receiver, and the receiver receives communications from the transmitter, by spread-spectrum short-range wireless communication. The plurality of multiplexed channels corresponds to 360 degrees of vehicle heading directions sectionalized in a standardized manner into multiple discrete sectors, each of which has a unique one of the pre-assigned multiplexed access codes. The dedicated data includes speed limit and traffic warnings, and data indicating a status of a traffic signal light. The transmitter broadcasts, by wireless communication, general non-dedicated data on an additional multiplexed channel for reception by any mobile road vehicle within range of the transmitter regardless of heading direction of the mobile road vehicle. The general non-dedicated data includes a local message number for local emergency or violation reporting, and details of junctions and intersections. The receiver also receives other dedicated data on at least one secondary multiplexed channel for the heading direction. The transmitter includes at least one low-range satellite transmitter, and the low-range satellite transmitter broadcasts, by wireless communication, dedicated instructions on a priority channel for at least one of the heading directions of the mobile road vehicle, the dedicated instructions instructing the receiver to receive other dedicated data on a secondary multiplexed channel for the heading direction. The low-range satellite transmitter broadcasts the other dedicated data on the secondary multiplexed channel for the heading direction. The receiver receives, under ordinary conditions, the dedicated data on the multiplexed channel that corresponds to an actual heading direction of the mobile road vehicle, and to receive, upon instruction, other dedicated data on a secondary multiplexed channel for the heading direction. The receiver receives the dedicated data on the secondary multiplexed channel in a high road density area, during approach of the mobile road vehicle to a traffic control light, and during a temporary period of traffic management by a local authority.

Another aspect of the invention features a multiple-redundant vehicle heading direction identification system that includes a GPS direction identification system for use within a mobile road vehicle, a multiple digital compass system for use within the mobile road vehicle programmed to identify a heading direction of the mobile road vehicle based on input from multiple digital compasses, and a central processing unit. The central processing unit is programmed to select the heading direction produced by the GPS direction identification system when an output of the GPS direction identification system is healthy, and to select the heading direction produced by the multiple digital compass system when an output of the GPS direction identification system lacks signal integrity.

Another aspect of the invention features an integrated multifunction unit for intelligent transport communication, for use within a mobile road vehicle, that includes a receiver, a vehicle heading direction identification system, and a central processing unit. The receiver is capable of multiple channel reception, and receives road-side-to-vehicle wireless communications from a road-side transmitter on one of a plurality of multiplexed channels having dedicated data for each of a corresponding plurality of heading directions of the mobile road vehicle. The central processing unit causes the receiver to receive dedicated data on at least one of the multiplexed channels that corresponds to an actual heading direction of the mobile road vehicle.

In certain embodiments, the integrated multifunction unit also includes a mobile communication system for use within the mobile road vehicle to send and receive messages to and from the mobile road vehicle, a gyro for detecting roll-over of the mobile road vehicle, and a vehicle airbag activation detector. The mobile communication system sends an emergency message in response to detection of a roll-over by the gyro and in response to detection of airbag activation by the airbag activation detector. The emergency message includes vehicle coordinates and a vehicle unique emergency call number, by use of which traffic authorities can call or page the mobile road vehicle. The mobile communication system transmits real-time traffic management reports and real-time traffic violation reports to a local traffic authority in order to enable centralized traffic management. The central processing unit is programmed to compare a speed limit received from a road-side transmitter with a speed received from a speedometer and to provide a warning to a driver of the mobile road vehicle that a speed of the mobile road vehicle exceeds the speed limit, and to cause the mobile communication system to send a message to a traffic violation center on a real-time basis when the speed of the vehicle exceeds the speed limit by a defined grace speed for a defined time. The central processing unit is programmed to cause a status of traffic signal lights or ramp meters to be indicated to a driver of the mobile road vehicle in response to data received from the road-side transmitter. The mobile communication system sends a message to a traffic violation center when the mobile road vehicle crosses a red traffic signal light.

In certain other embodiments, an in-vehicle transmitter is programmed for communication with the receiver of an integrated multifunction unit of a second mobile road vehicle. The in-vehicle transmitter transmits using a frequency and bandwidth different from a frequency and bandwidth used by the road-side transmitter. The in-vehicle transmitter transmits a message containing coordinates of the first mobile road vehicle to the second mobile vehicle. The in-vehicle transmitter re-transmits, in relay fashion, a message received by the receiver of the first mobile road vehicle from a transmitter of an integrated multifunction unit of a third mobile road vehicle. The message transmitted in relay fashion is transmitted in a lowest available time slot for retransmission, in a frequency of the message received from the third mobile road vehicle plus a frequency increment of one. The receiver receives a communication from an in-vehicle transmitter of an integrated multifunction unit of another mobile road vehicle, and the receiver verifies that the other mobile road vehicle is located ahead by verifying coordinates of the other mobile road vehicle included in the communication from the in-vehicle transmitter of the other mobile road vehicle. The receiver scans for vehicle-to-vehicle transmissions from mobile road vehicles on approach roads to an intersection, based on intersection details received by the receiver from the road-side transmitter, and the central processing unit plots coordinates of mobile road vehicles on approach roads, computes possibility of collision, and provides a warning to a driver of the mobile road vehicle based on the possibility of collision.

Another aspect of the invention features an integrated multifunction unit for intelligent transport communication, for use within a mobile road vehicle, that includes a subscriber identity module, a mobile communication system, and a central processing unit. The mobile communication system receives a coded message from a vehicle registering authority, and sends intermittent messages to a licensing office number identified in the subscriber identity module. The central processing unit causes the subscriber identity module, in response to receipt by the subscriber identity module of a coded message from the vehicle registering authority, to send the intermittent messages to the licensing office number identified in the subscriber identity module. The intermittent messages contain vehicle coordinates and vehicle details based on information in the subscriber identity module.

The details of various embodiments of the invention are set forth in the accompanying drawings and the description below. Numerous other features and advantages of the invention will be apparent from the description, the drawings, and the claims.

DESCRIPTION OF THE DRAWINGS

FIG. 8 is a table that details a multiplexed code matrix used by transmitters and mobile vehicular units according to the invention.

Figure 1:
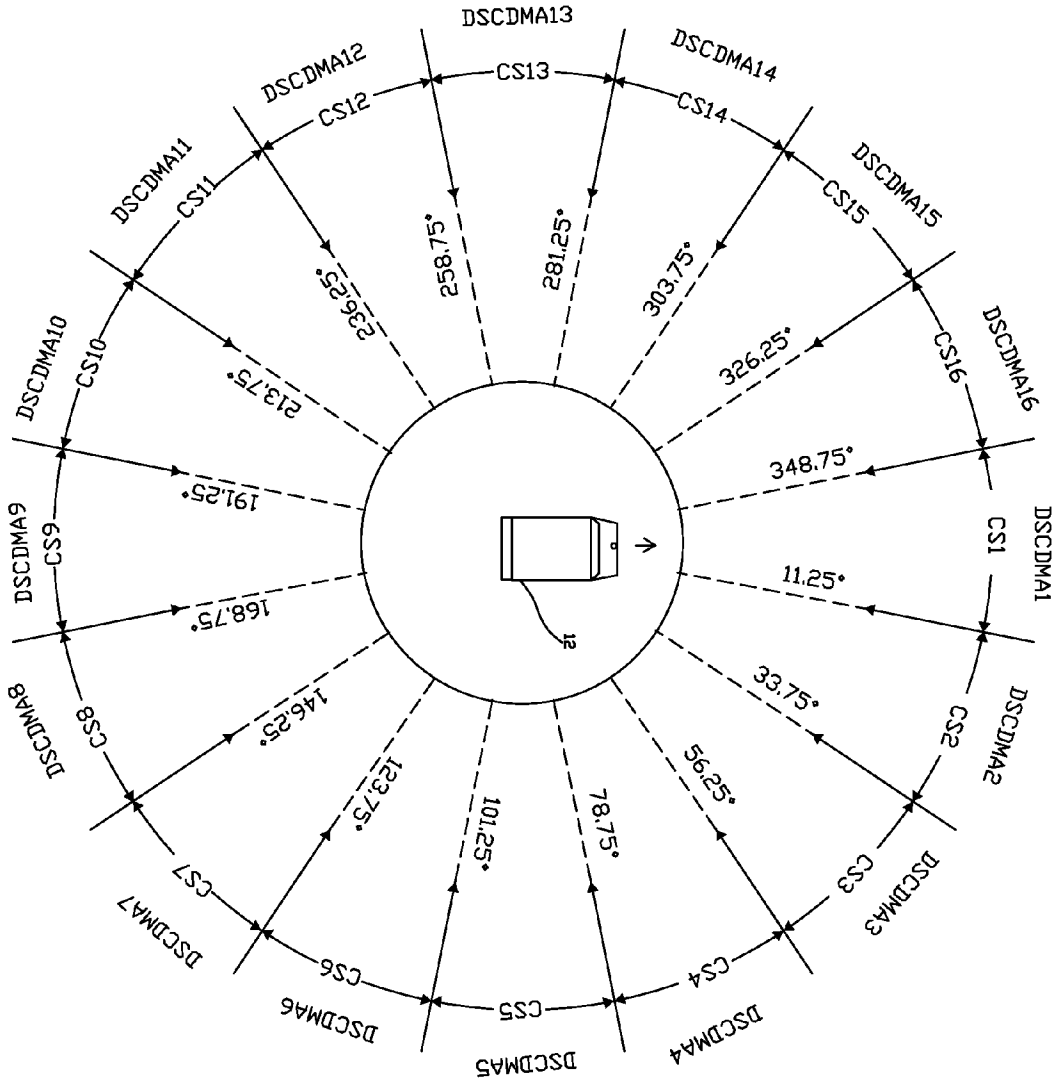
FIG. 1 is a diagram of a vehicle, with the possible directions the vehicle can travel being divided into sixteen equal segments each having a unique multiplexed access code.

The drawings are for illustration and are not necessarily drawn to scale. Numerous modifications and departures from the specific embodiments shown in the drawings will become apparent from the following detailed description and from the claims.

DETAILED DESCRIPTION

In order to implement the traffic management and control system in accordance with the invention, different multiplexed channels are assigned for communication of general data and directional data for each of a plurality of directional sectors, to realize the following:

1. real-time central monitoring of traffic signal violations;
2. real-time central monitoring of speed violations;
3. real-time vehicle fraud and identity detection;
4. real-time traffic rule compliance detection;
5. real-time centralized traffic flow management;
6. real-time in-vehicle audio and/or video traffic signal indication and warnings;
7. real-time road toll collection;
8. automatic notification of emergency situations;
9. vehicle detection for theft or emergency;
10. advanced parking management;
11. commercial directional information and advertisements;
12. tamper reporting with backup;
13. traffic flow analysis;
14. traffic accident analysis; and
15. vehicle-to-vehicle communication.

We turn first to the technical details of the unique communication scheme provided by the invention, in which communication is standardized based on direction. In particular, FIG. 1 illustrates a vehicle 12, shown oriented towards true north, i.e., zero degrees. The direction vehicle 12 can take is illustrated by a circle around it. All possible directions the vehicle can travel, i.e., 360 degrees, are shown around vehicle 12, with zero degrees set in line with true north. The direction vehicle 12 can travel is divided into 'n' number of practical segments. For illustration purpose sixteen sectors CS1-CS16 are used to define the directional segments. Thus, the full circle of 360 degrees is divided into sixteen equal segments or sectors of 22.5 degrees, each providing a unique travel direction segment for any vehicle. DS CDMA multiplexing is used for illustration. Thus, for each segment a unique multiplexed access code is assigned, as per the example DSCDMA codes 1 to 16. Also, for each sector of vehicle heading a unique multiplexed access code DSCDMA1-DSCDMA16 is assigned, so that for each segment a unique multiplexed signal can be used, which is tuned for reception by a mobile vehicular unit within vehicle 12 based on direction of travel of the vehicle as obtained from GPS or compass units within the vehicle, as is described in detail below. Thus, for example, when vehicle 12 is travelling in the true north direction, it is travelling within the degrees of segment identified SC1, for which a multiplexed code DSCDMA1 is assigned, and the vehicle is tuned to receive DSCDMA1, and thereby to establish specific communication relevant only for the path on which the vehicle is travelling.

A road-side stationary transmitter broadcasts specific directional traffic details of each approach road over the multiplexed access code standardized as per FIG. 1. Transmission by any one road side transmitter is done using a maximum of seventeen unique multiplexed access channels; one channel for general data transmission, available to all vehicles in range, and the remaining sixteen multiplexed access channels each being dedicated for one unique travel segment, standardized based on the direction of vehicle as illustrated in FIG. 1. For example, for approach road having direction 100 degrees, broadcast is done using DSCDMA5. Thus, information and instructions specific to the direction of travel of the vehicle is relayed to the vehicle by means of the multiplexed codes based on the direction of travel of the vehicle, acting in a way similar to human eyes perceiving the signs and traffic lights turned in a person's direction.

Wide-spectrum short-range wireless communication in a region of high attenuation for low-range transmission is employed, due to its better consistency and ability for reuse. In the United States and Japan, a frequency of 5.85 GHZ is used with a bandwidth of 75 MHZ, and in Europe a frequency of 63-64 GHZ is used with a bandwidth of 192 MHZ. This is because, for ITS application, 5.85 GHZ is assigned in the United States and Japan, and 63-64 GHZ is assigned in Europe. The use of these frequencies is considered for illustration, since these frequencies possess the required properties as specified and have been specified for intelligent traffic communication by the United States and European countries. Also transmitter/receivers in or near this range of frequency have already been developed. Based on the EM wave properties and licensing requirements, appropriate frequencies for different countries can be adapted.

Vehicle 12 includes a mobile vehicular unit programmed to tune to the broadcast from the road-side stationary transmitter based on the direction of travel of the vehicle.

The mobile vehicular unit includes a frequency/receiver for receiving broadcasts from the road-side stationary transmitter. Since the direction of the vehicle is critical to the tuning process, the mobile vehicular unit obtains direction from a GPS system for its heading, backed up by multiple digital compasses that provide stable and reliable direction input for tuning the receiver, so that the mobile vehicular unit can receive the data sent over the multiplexed channel assigned for its travel direction. Thus, to determine the direction of vehicle 12, two independent and reliable sources are used, so that redundancy and very high availability are ensured: a GPS system and a two-out-of three compass system that is frequently corrected for errors. The mobile vehicular unit, based on the travel direction identified to it by the redundant GPS/compass system, tunes to the multiplexed access channel that is standardized for the direction of travel of the vehicle, and thereby receives specific instructions and information filtered and communicated for the heading direction of the vehicle. In order to account for a margin for error, the mobile vehicular unit scans plus and minus five degrees from the direction provided by the GPS and compass sources, and if this scan falls within two of the segments, the mobile vehicular unit scans for multiplexed communications for both of the segments, and picks up the strongest of the multiplexed communications with increasing signal strength.

Figure 2:
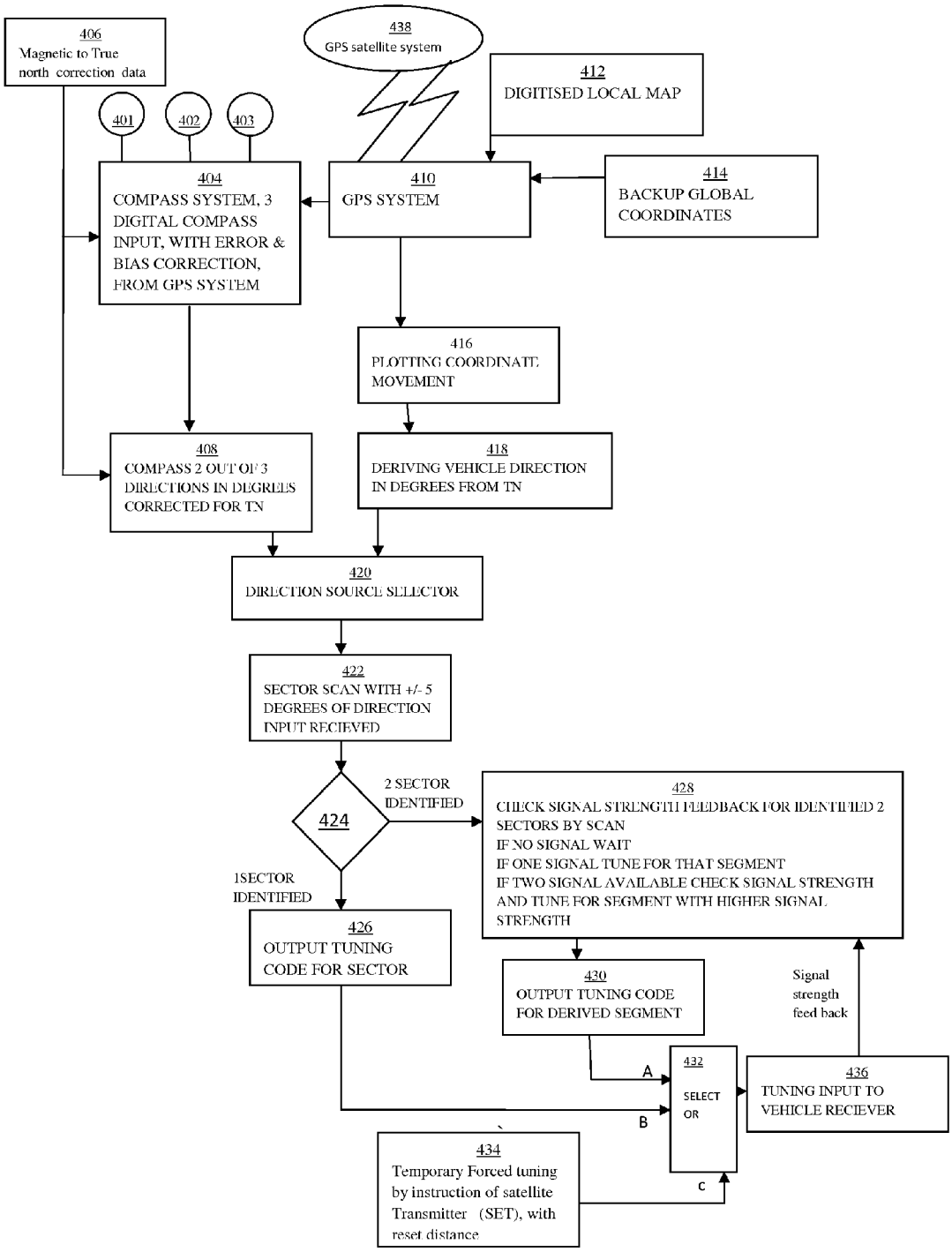
FIG. 2 is a flow chart of the operation of the receiver unit of a mobile vehicular unit.

FIG. 2 provides a flow chart of the operation of the receiver unit of the mobile vehicular unit. Digital flux compasses 401 and 402 and fiber-optic gyro compass 403, each with +−1 degree error, are employed in compass system 404 using a two out of three voting logic to determine the vehicle direction. The output of compass system 404 is corrected for true north in block 408, which also receives true-to-magnetic-north correction details from block 406.

A GPS system 410 receives input from GPS satellite system 438, digitized local map 412 and backup global coordinates 414. Based on input from GPS system 410, coordinate movement is plotted in block 416 and the vehicle direction is derived in degrees from true north in block 418. The GPS system 410 and compass system 404 together provide a redundant, reliable, safe, and highly available vehicle travel direction output, which is used by the mobile vehicular unit to tune to receive the multiplexed access code assigned for its travel direction. In particular, when the GPS is healthy, direction source selector 420 selects GPS system 410 as the source of vehicle direction. When the GPS signal is unavailable or during lack of GPS signal integrity, direction source selector 420 selects compass system 408 as the source of vehicle direction.

In block 422, a plus-and-minus five degrees band scan is performed relative to the direction input received from direction source selector 420, in order to improve overall system stability and accuracy. In block 424, if only one sector is identified within the band scan of block 422, the tuning code for that sector is outputted (block 426), and if two sectors are identified, flow proceeds to block 428. In block 428, the receiver unit checks the signal strength feedback for the two sectors identified by the band scan of block 422. If no signal is available, the receiver unit waits. If one signal is available, the receiver unit tunes for the segment corresponding to the received signal. If two signals are available, the receiver checks the signal strength of the two signals and tunes for the segment having the higher & increasing signal strength. In block 430 the receiver then outputs the tuning code for the segment derived in block 428. A selector 432 receives the tuning codes from block 426 (input channel A), block 430 (input channel B), and block 434 (input channel C, which corresponds to temporary forced tuning by instruction of a satellite transmitter accompanied by a reset distance). When tuning input is available in priority input channel C, selector 432 outputs this input C. In the absence of tuning input in priority input channel C, if two sectors are identified in block 424, selector 432 selects input B, and if only one sector is identified in block 424, selector 432 selects default input A. The tuning input to the vehicle receiver is selected in block 436 based on the output of selector 432, and a signal strength feedback is provided from block 436 to block 428.

As a result of the process set forth in FIG. 2, when the vehicle is in range of a transmitter, the specific data for its direction of travel is received by the vehicle over the assigned directional multiplexed channel of its travel direction, and general data is received over a general multiplexed channel.

The forced reception of block 434 is a priority and is implemented for approaches to traffic control signal junctions to provide improved stability and safety, for additional filtration in cases of high density roads to avoid interference, and to provide for the possibility of improvisation to local authorities for temporary traffic diversion and traffic management. Such instructions are communicated by a satellite transmitter installed on or across the road on which the vehicle travels and is limited to a low range of transmission.

The design objective of the advanced vehicle traffic management and control system provided the invention is to provide sufficient advance warning to drivers of vehicles, followed, in certain embodiments of the invention, by violation reporting to increase driver accountability, but to continue to allow decision making and control by the driver of the vehicle.

In order to accomplish these objectives, the overall advanced vehicular traffic management and control system includes the following features: A communication transmitter and receiver system is provided that functions in accordance with the flow chart of FIG. 2. A wide-spectrum EM GHZ frequency, having high attenuation properties, serves as media of communication between stationary road-side units and mobile vehicular units and for vehicle-to-vehicle communication.

The mobile vehicular unit includes a vehicular mobile receiver/transmitter for receiving unique direction-based and general multiplexed signals, having a GPS unit, compass system, GSM/CDMA/satellite communication capable of messaging to a central control room, touch screen graphical interface, finger swipe, and emergency options.

Also, the following computer programs are provided: A computer program in vehicle unit computes the direction of the vehicle based on GPS and compass input, tunes the receiver of the mobile vehicular unit based on direction, obtains general and directional instructions, and computes the received data to realize advanced vehicular traffic management and control. A computer program in central control is also provided for traffic management, vehicle fraud identification, emergency management, traffic violation management, and traffic analysis. A computer program in a central control or concerned office is provided for toll collection and parking management based on entry and exit of vehicle from toll plazas or parking lots. A computer program is also provided in a central control room or authorized office for parking management.

Figure 4:
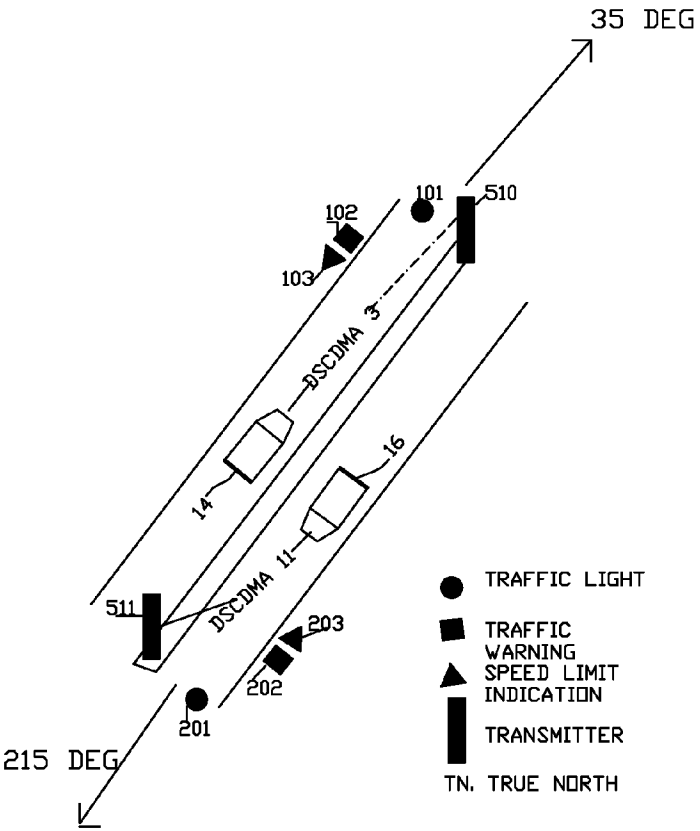
FIG. 4 is a diagrammatic map illustrating two vehicles travelling in opposite directions on a road with transmitters according to the invention provided to transmit data to mobile vehicular units within the vehicles.
Figure 3:
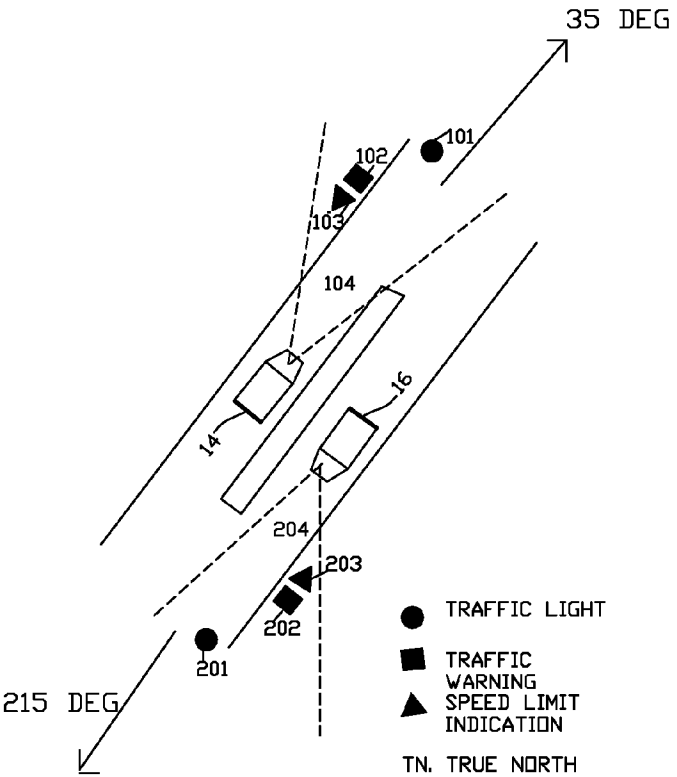
FIG 3 PRIOR ART
FIG. 3 is a diagrammatic map illustrating two vehicles travelling in opposite directions on a road without the benefit of the advanced vehicle traffic management and control system provided by the invention.

FIG. 3 illustrates two vehicles 14 and 16 travelling in opposite directions, in road directions angled respectively about 35 degrees and 215 degrees from true north, without the benefit of the advanced vehicle traffic management and control system provided by the invention. The drivers of each vehicle observe, within their respective lines of sight 104 and 204, the traffic lights 101 and 201, warning signs 102 and 202, and speed limit indications 103 and 203 that are installed to face them in their travel direction. Traffic lights 101 and 201, warning signs 102 and 202, and speed limit indications 103 and 203 are kept opposite to the direction of travel of vehicles 14 and 16, and therefore in line of sight of the drivers of the vehicles. The driver of vehicle 14 sees traffic light 101, warning sign 102, and speed limit indication 103 in the driver's line of sight, and the driver of vehicle 16 sees traffic light 201, warning sign 202, and speed limit indication 203 in the driver's line of sight FIG. 4 illustrates the same situation, but with transmitters 510 and 511 according to the invention provided to transmit data to mobile vehicular units within vehicles 14 and 16. Vehicles 14 and 16, based on their directions (about 35 degrees and 215 degrees from true north respectively), are tuned to receive multiplexed communications intended for their respective directions of travel, and through these communications vehicles 14 and 16 receive the details and status of traffic signals 101 and 102 and warnings intended for their direction of travel. In particular, transmitter 510 transmits data regarding signal light 101, warning sign 102, and speed limit indication 103 in access code DSCDMA3. Vehicle 14, based on its direction, is tuned to receive access code DSCDMA3, and therefore receives the details of signal light 101, warning sign 102, and speed limit indication 103. Likewise, transmitter 511 transmits data regarding signal light 201, warning sign 202, and speed limit indication 203 in access code DSCDMA11. Vehicle 16, based on its direction, is tuned to receive access code DSCDMA11, and therefore receives the details of signal light 201, warning sign 202, and speed limit indication 203. The receivers within vehicles 14 and 16 in FIG. 4 serve the same function as the human eyes in the case of FIG. 3, but without the possible factor of overlook or careless error.

The transmission system of transmitters 510 and 511 consists of transmitter circuitry and an antenna, to transmit data by means of wide spectrum using 5.85 to 5.925 MHZ or 63.6 to 63.792 MHZ, and capable of communicating in a total of 161 channels. For any single transmission unit, a maximum of 17 channels may be required, but most often the number of channels will be limited to about 10 channels or less. The transmitters 510 and 511 get their data from a central control room by means of remote communication.

Figure 5:
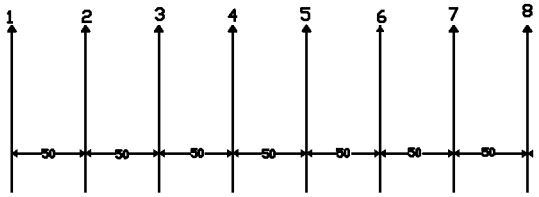
FIG. 5 is a diagrammatic map illustrating a high-density area of roads in which more than one signal intersection may exist within a 500-meter range.
Figure 6:
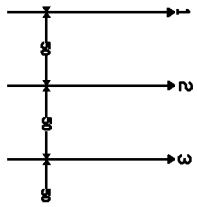
FIG. 6 is another diagrammatic map illustrating a high-density area of roads in which more than one signal intersection may exist within a 500-meter range.
Figure 7:
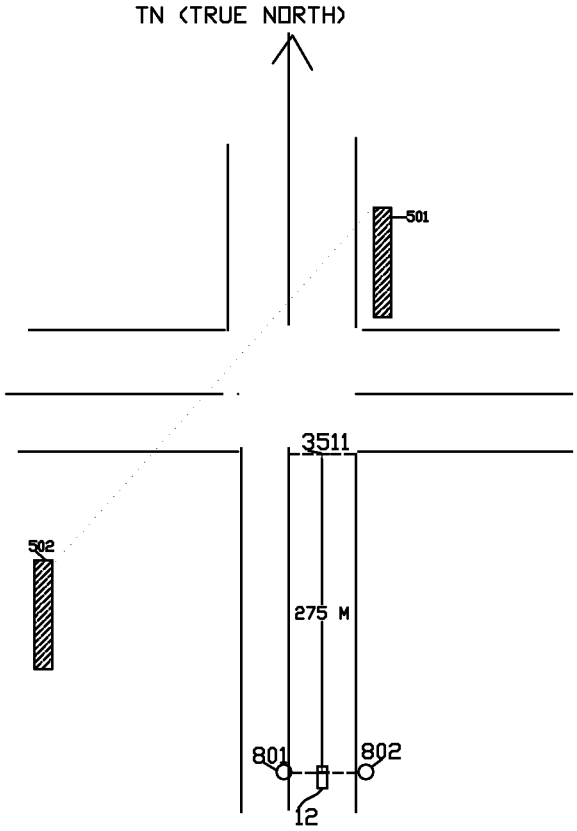
FIG. 7 is a diagrammatic map of a particular traffic intersection with twin satellite transmitter/receivers according to the invention provided on the approach road to the intersection.

FIGS. 5, 6, and 7 illustrate a high-density area in which more than one signal intersection may exist within a 500-meter range, thereby creating a possibility of multiple reception from two or more intersections, since the reception is based on direction. In these instances priority directional instruction also is provided by satellite transmitters, having only a 30-to-40-meter range, which instruct the vehicle to follow either base code DSCDMA04-0, or, based on signal density additional filtering, DSCDMA04-6, for example, for the next 350 meters. The satellite transmitter also provides to the vehicle unit the distance to the traffic signal crossing line, thereby enabling the vehicle unit to identify any signal violation. During these periods of approach to signal intersections, the vehicular unit will become independent of other sources, including its directional system, for improved safety and reliability.

For example, FIGS. 5 and 6 illustrate multiple intersections in close proximity that could result in signal overlap, because all intersections fall in the same direction. Where there is a high density of cross-roads in the same direction, with signal lights at the intersections, additional multiplexing is applied by control instruction, for improved safety and stability.

In order to avoid signal interference each direction segment is provided with eight multiplexed variants to the normal base channel, to take care of signal interference in the high road density area. For example, the division multiplexed code may be applied, in which the base code uses time slot one and variants use time slots two through eight and priority instructions are conveyed by time slot 9. With this arrangement, unique channels can be accommodated in high road density areas by providing additional filtering by instruction.

In FIG. 7, a particular traffic intersection with lights is shown, from a high road density area such as is shown in FIGS. 5 and 6, where the direction of vehicle travel is true north. Here, additional filtering requirements are set by twin satellite transmitter/receivers 801 and 802 on the approach road to the intersection. Because there are two transmitters 801 and 802, redundancy and feedback are enabled, with the directional antennae facing each other. The power level of satellite transmitters 801 and 802 is controlled, based on feedback, to the width of the road. Thus, the range of the satellite transmitters is limited to the width of the approach road. Satellite transmitters 801 and 802 communicate in DSCDMA(X)-9, where "X" is a number between one and sixteen, based on the direction of travel of vehicle 12.

Transmitter 501 and receiver 502 constitute a redundant set of transmitter with redundant feedback receiver, broadcasting data in a maximum of 17 channels capable of a range of 300 to 500 meters and mostly placed at intersection and junctions. The feedback receivers are installed at 92% of the required range in either direction so as to adjust the power level to provide a constant range in any diverse climatic condition, and to avoid unwanted signal overlap.

When vehicle 12 heading true north passes satellite transmitters 801 and 802 that are transmitting in the direction towards each other using priority code DSCDMA1-9, the power levels of transmission are controlled by feedback receivers of transmitters 801 and 802 to slightly above a threshold point below which mobile vehicular units discard the signal.

The signal strength that the mobile vehicular unit within vehicle 12 experiences is highest as the vehicle crosses the path of transmitters 801 and 802 as shown. Then the strength decreases, at which point an odometer memory set to 0.0 is released for measurement within the mobile vehicular unit, and a new receive access code is also set. As is shown in FIG. 7, from this point traffic crossing line 3511 is 275 meters. The mobile vehicular unit of vehicle 12 monitors for any violation of a red traffic signal at the intersection, and another 25 meters later all assigned filtering is released so that signal reception based on vehicle direction can continue as the vehicle continues its travel.

Satellite transmitters 801 and 802 issue commands, which are set in the memory of the mobile vehicular unit of vehicle 12 at the first instance of a decrement in signal strength. In particular, satellite transmitters 801 and 802 set multiplexed codes in case additional filtering is needed based on the density of traffic signals. If this code is set, the distance for which the filtering code has to be retained is also set. For example, satellite transmitters 801 and 802 may set filtering code DSCDMA6-6 for a distance of 300 meters. If the density of traffic is less, the satellite transmitters may issue the same instruction, but with DSCDMA6-0, the base code, to make vehicle 12 independent of any external factor during the run-up to the traffic signal control lights, for improved safety.

Satellite transmitters 801 and 802 also provide additional instructions identifying the distance to the signal crossing. For example, the satellite transmitters might instruct that the distance to the signal crossing from odometer setting 0.0 is 275 meters from the location of the satellite transmitters. These instructions are set in the memory of the mobile vehicular unit of vehicle 12 at the first instance of an identified decrement in signal strength, at which instance an odometer reading of 0.0 is set in memory in the mobile vehicular unit, and then 275 meters are measure by the mobile vehicular unit. When vehicle 12 passes 275 meters (providing for a grace distance of one meter), the mobile vehicular unit checks whether the traffic signal is red, and if the traffic signal is red the mobile vehicular unit sends a violation message. The mobile vehicular unit continues to count until the vehicle passes 300 meters, at which point the reception filtering is released, so as to allow the mobile vehicular unit to follow its standard receiver tuning procedure based on vehicle direction.

FIG. 8 is a table that details the multiplexed code matrix used by the transmitters and mobile vehicular units. The table includes a number of different types of multiplexing codes. In particular, there is one general communication multiplex code DSCDMA0, for transmitting location-specific general data to be received by all mobile vehicular units regardless of vehicle direction. There are also sixteen different and distinct DSCDMA base codes DSCDMA1-0 through DSCDMA16-0, for communication from a stationary transmitter to vehicles depending on the vehicle direction, as detailed in column headed "communication segment within angles as measured from true north." Also, there are eight variations to each directional multiplexed DSCDMA base code, DSCDMA(X)-1 to DSCDMA(X)-8, where "X" is the directional multiplexed code number 1-16 as described above. These eight variations constitute additional filtering available for each direction, assigned by a satellite transmitter, for use in dense traffic signal areas, where more than one road intersection exists within 350 meters, or, more generally, for use in providing communication stability during approaches to traffic control signals. This configuration accommodates up to eight parallel intersections within a distance of 350 meters. There is also one priority directional code DSCDMA(X)-9, for each directional segment of travel, that communicates priority filtering instructions for the mobile vehicular unit to respond to on priority. For vehicle-to-vehicle communication, a forward communication code is provided in another frequency and bandwidth.

Figure 9:
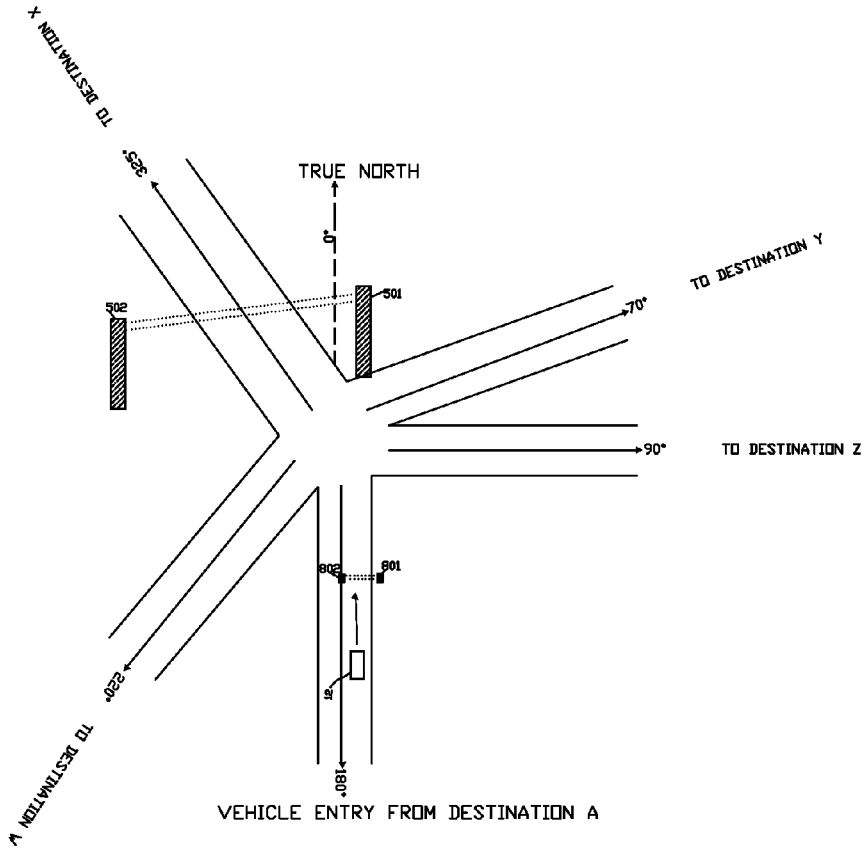
FIG. 9 is a diagrammatic map of an intersection of roads, with a fixed transmitter and satellite transmitter receivers according to the invention provided in the area of the intersection.

FIG. 9 illustrates communication between fixed transmitter 501 and a mobile vehicular unit in a vehicle 12, as well as communication between satellite transmitter/receivers 801 and 802 and the mobile vehicular unit in vehicle 12, at an intersection of roads, for recreation of real-time signal status in a vehicle display unit within vehicle 12. Details such as the number of exits in the intersection, together with the angle and destination of each exit, and the presence of a signal light at the intersection, are provided by general multiplexing code. The signal light status and time remaining for change of the signal light status is received from the directional transmitter.

FIG. 9 shows one fixed general and directional transmitter 501 and a set of fixed satellite transmitters 801 and 802, both redundant and with receivers. Satellite transmitters 801 and 802 provide instruction for additional filtering or reception anchoring requirements to vehicles at close range, and also set an accurate distance to evaluate traffic signal violation on approach to traffic lights by vehicular units.

In particular, at each such intersection, fixed communication transmitter 501 communicates the following control details by general communication channel DSCDMA0: the number of exits in the intersection, together with the angle and destination of each exit from 0 degrees, i.e., true north. For example, in FIG. 9, the exit to Destination Y is 70 degrees from the direction of travel (true north), the exit to Destination Z is 90 degrees from the direction of travel, the exit to destination W is 220 degrees from the direction of travel, and the exit to Destination X is 325 degrees from the direction of travel. This information is used by the computer in the mobile vehicular unit to compute all exits from its approach road. A direction communication in one of communication channels DSCDMA1-DSCDMA16 communicates the real-time traffic light details that are relevant for the road on which vehicle 12 approaches the intersection. In FIG. 9, fixed general redundant transmitter 501 has a range of 300 to 500 meters, and fixed redundant feed-back receiver 502 is provided to regulate the range of transmitter 501 to 300 to 350 meters.

In the event of dense signal areas or approach to a traffic control signal light, satellite transmitters 801 and 802 provide specific receive codes and identify to vehicle 12 the exact distance from satellite transmitters 801 and 802 to the cross line at the intersection having the traffic signal light.

With the detail provided by transmitter 501 and satellite transmitters 801 and 802, the computer in the mobile vehicular unit identifies and announces the presence of traffic signal lights and ramp metering, causes the current traffic status to be displayed, computes and indicates the expected traffic signal upon the vehicle reaching the traffic control signal in order to provide necessary forewarning, and, in instances of red light crossing, messages to a local traffic violation number the vehicle details, coordinates, and time of violation. The computer also reproduces the intersection road and signal status for each exit from its road of approach by real-time graphics in the graphical unit as is illustrated in FIG. 10.

Figure 10:
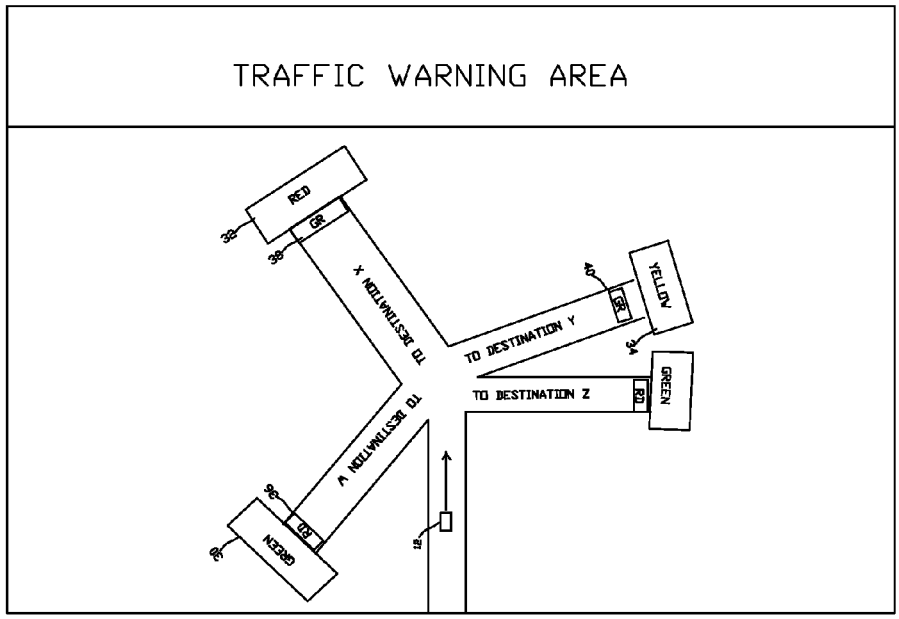
FIG. 10 is a graphical representation of a display of a computer in a mobile vehicular unit according to the invention, the display representing the intersection of roads of FIG. 9.

FIG. 10 reconstructs the graphical real-time representation of an intersection, at time t0 when vehicle 12 is about 200 meters from the intersection. Large blocks 30, 32, and 34, colored green, red, and yellow respectively, show the status of the traffic signal at time t0. Small blocks 36, 38, and 40, with abbreviations GR and RD, represent the status of the respective signals for vehicle 12 at the intersection if the vehicle continues at the same speed. The computation for small blocks 36, 38, and 40 is done in real time and updated every second as the speed of vehicle 12 varies.

The number of roads at the intersection, the angles of the roads and their destinations, and the number of the traffic signal lights present on all approach roads to the intersection, are conveyed by general multiplexed transmission, available to all vehicles. The status of the traffic signal are transmitted by specific direction multiplexed signals, filtered by the mobile vehicular unit of vehicle 12 based on the direction of travel of the vehicle or as assigned by the satellite transmitter.

Figure 16:
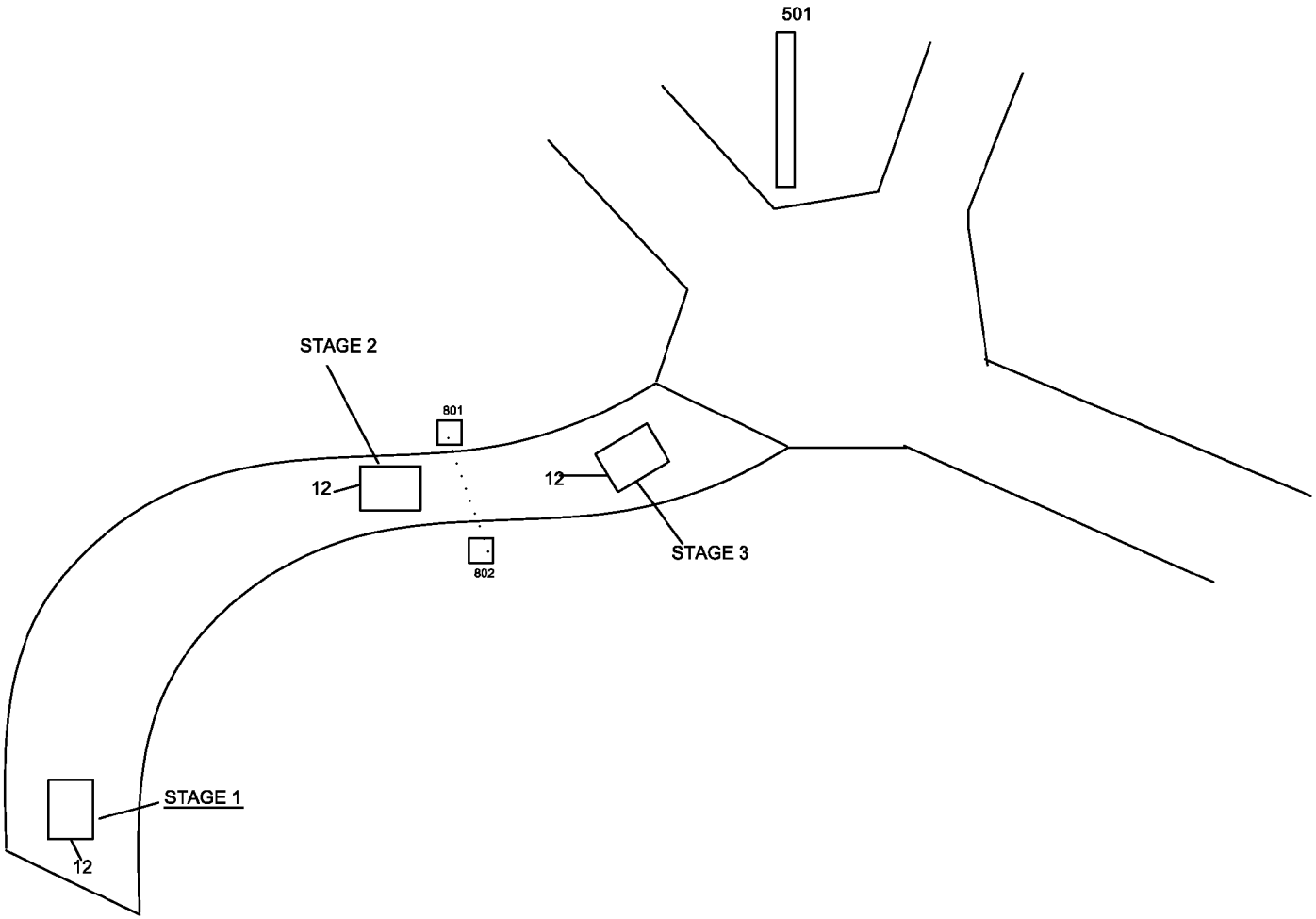
FIG. 16 is a diagrammatic map of an intersection of roads, with one of the approach roads having curvature, and with a fixed transmitter and satellite transmitter receivers according to the invention provided in the area of the intersection.

FIG. 16 illustrates communication between fixed transmitter 501 and a mobile vehicular unit in a vehicle 12, as well as communication between satellite transmitter/receivers 801 and 802 and the mobile vehicular unit in vehicle 12, at an intersection of roads with a signal light, where vehicle 12 approaches the intersection on a road having curvature. In Stage 1, vehicle 12 is headed true north, and the receiver of vehicle 12 is tuned for general channel DSCDMA0, directional traffic channel DSCDMA1-0, and directional priority channel DSCDMA1-9. In Stage 2, when vehicle 12 is headed 90 degrees from true north, satellite transmitters 801 and 802 communicate over DSCDMA5-9 to convey instruction to vehicle 12 to proceed for the next 375 meters with DSCDMA5-7, as vehicle 12 crosses satellite transmitters 801 and 802. During Stage 2, the receiver of vehicle 12 is tuned for general channel DSCDMA0, directional traffic channel DSCDMA5-0, and directional priority channel DSCDMA5-9. In Stage 3, when vehicle 12 approaches the signal crossing headed 50 degrees from true north, the receiver of vehicle 12 is tuned for general channel DSCDMA0, directional traffic channel DSCDMA5-7 based on the prior instruction from satellite transmitters 801 and 802, and directional priority channel DSCDMA3-9 based on the heading direction of 50 degrees from true north.

During stages 2 and 3, transmitter 501 transmits general data to vehicle 12 on general channel DSCDMA0 and dedicated traffic instructions for vehicle 12 on directional traffic channel DSCDMA5-7. According to the direction of vehicle 12 near the junction, traffic instruction should have been communicated in DSCDMA3-0 from transmitter 501 to the receiver in vehicle 12, but due to instruction from satellite transmitters 801 and 802 the reception was anchored at a multiplexing code of instruction, DSCDMA5-7, and so both transmitter 501 and the receiver in vehicle 12 execute communication in DSCDMA5-7. Vehicle 12 enters the range of transmitter 501 immediately after passing satellite transmitters 801 and 802 and, for improved stability, vehicle 12 continues to receive communication from transmitter 501 on an anchored channel until vehicle 12 passes beyond the signal crossing, even though there is a change in direction of vehicle 12.

In a similar manner, satellite transmitters 801 and 802 can assign multiplexed code wherever additional filtration is required, such as at high-density areas where signal overlap is possible, in order to avoid interference.

Figure 11:
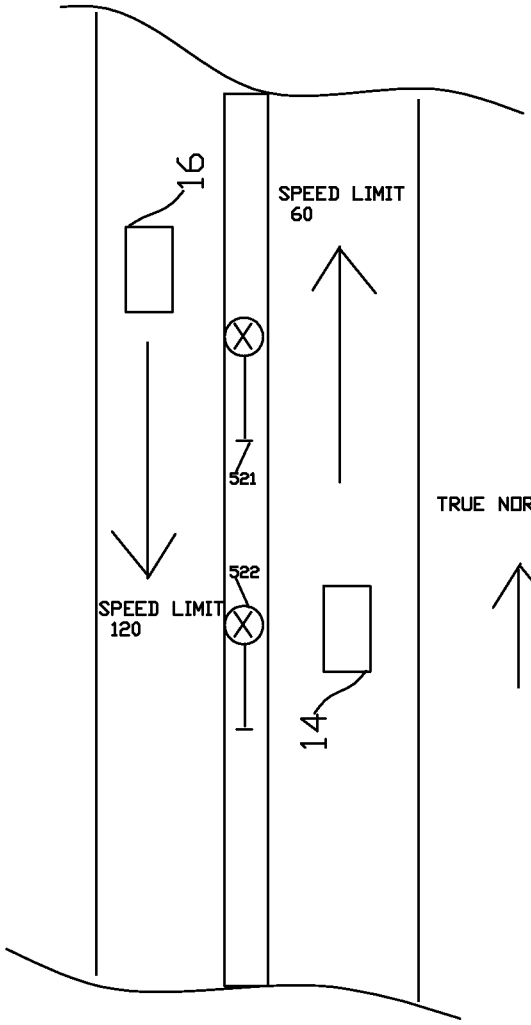
FIG. 11 is a diagrammatic map of a road, illustrating a redundant pair of speed limit transmitters according to the invention that transmit speed limits to vehicles on the road.

FIG. 11 illustrates a redundant pair of speed limit transmitters 521 and 522, transmitting speed limit 60 kilometers per hour to car 14 travelling in true north direction and speed limit 120 kilometers per hour to car 16 travelling in the opposite direction on the same road. Due to the fact that instructions are received over multiplexed communication based on directional filtering, the car 14 travelling north receives only data indicating 60 kilometers per hour as speed limit and car 16 travelling south receives only 120 kilometers per hour as speed limit. Redundant transmitter/receivers 521 and 522 transmit in two multiplexed signals corresponding to two directions of the road, in this case true north and south. Vehicle 14 heading north is tuned in to receive for direction north (i.e., DSCDMA1) and receives speed limit 60 kilometers per hour. Vehicle 16 heading south receives speed limit 120 kilometers per hour as it is tuned for receiving multiplexed signals for direction south (DSCDMA9). Changes in speed limit of the road ahead are announced by audio and video announcement, and then the current speed limit of the road of travel is maintained on a graphical display in the vehicle.

Figure 12:
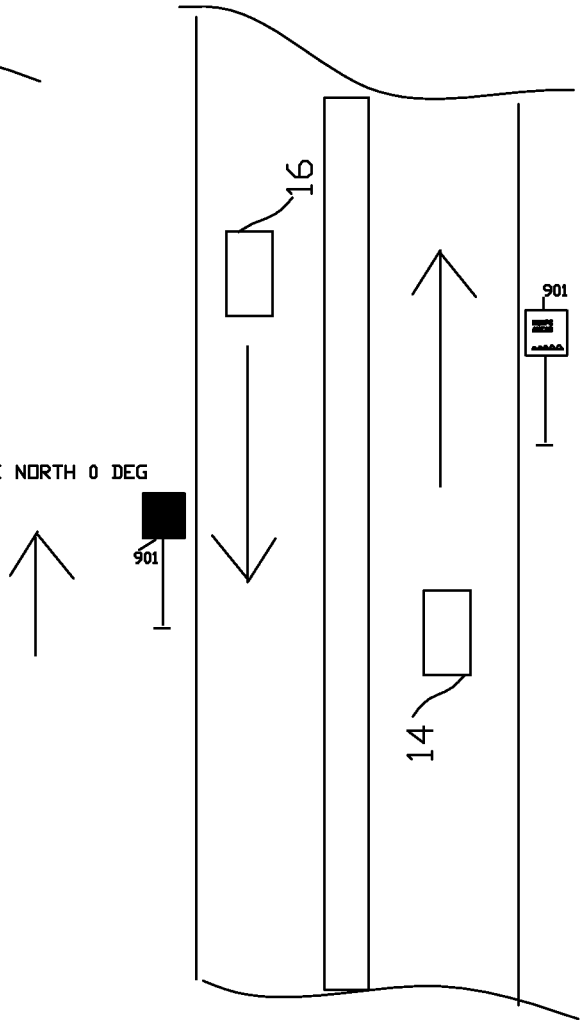
FIG. 12 is a diagrammatic map of a road, illustrating traffic warning sign boards according to the invention that operate as transmitters in accordance with the invention.

FIG. 12 shows vehicles 14 and 16 travelling north and south respectively on a road having traffic warning sign boards 901 and 902, which, in addition to providing visual information in the manner of standard sign boards, also operate as transmitters in accordance with the invention. Thus, traffic warning sign board 901 is seen by the driver of vehicle 14, and a corresponding warning is also transmitted to the mobile vehicular unit of vehicle 14. Likewise, traffic warning sign board 902 is seen by the driver of vehicle 16, and a corresponding warning is also transmitted to the mobile vehicular unit of vehicle 16. The mobile vehicular units in vehicles 14 and 16 are tuned to receive respective codes, and therefore receive traffic warnings appropriate for the respective directions of travel. Warning sign boards 901 and 902 include programmable units for setting transmission codes for any directional segment, thereby making the sign boards suitable for universal application, including selectability of the actual content conveyed by sign boards 901 and 902. The sign boards may be powered by solar-powered units, with battery as appropriate, as power consumption is very low. The mobile vehicular units include a user-selectable on/off switch for audio alert corresponding to the warnings on the sign boards. Also, a video display on the mobile vehicular unit will flash in the warning area to alert the driver of the vehicle.

Figure 13:
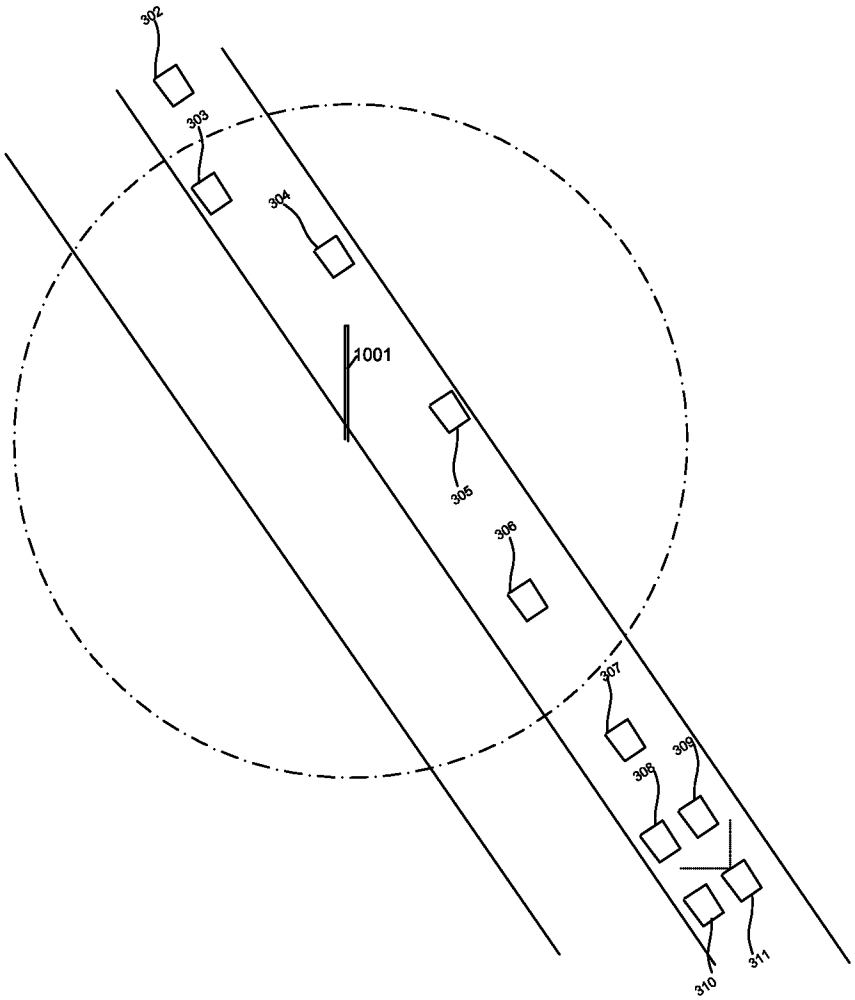
FIG. 13 is a diagrammatic map of a road, having a transmitter according to the invention and a set of vehicles that employ vehicle-to-vehicle communication in accordance with the invention.

FIG. 13 illustrates a vehicle-to-vehicle communication system that will use a frequency and bandwidth different from that used for the transmitter-to-vehicle system described above. For example, a base frequency of 63.8 GHZ or 5.925 GHZ is used. The vehicle-to-vehicle communication system uses a directional mode of communication with relay-type transmission from vehicle to vehicle. The directional mode of communication ensures that all interference from other vehicles in different directions is avoided. The relay mode of communication (vehicle ahead to vehicle behind), ensured by sampling of the coordinates of each transmitting vehicle, ensures that the transmission is only by a vehicle ahead of the vehicle receiving the transmission, and the received coordinates of the vehicle ahead is analyzed by the in-vehicle unit of the vehicle that receives the transmission, in to provide a pre warning to avoid possible accident. A frequency increment function for retransmission, described below, ensures only one vehicle pair in the near vicinity will use the frequency being used by the transmitting vehicle, and thereby prevents any chance of interference. The vehicle-to-vehicle transmission will convey the coordinates of the transmitting vehicle, and any signaling data. The communication consists of three sections: one section for vehicle coordinates, one section dedicated for emergency communications, and the other section for general communications and advertisements. The contents of these three sections are relayed to any vehicle in range by road-side transmitter 1001, and relayed by the vehicle to next vehicle and so on.

In particular, the roadside-to-vehicle transmission for vehicle-to-vehicle communication operates as follows: All vehicles in range of transmitter 1001 tune to the base code, base frequency of the band allocated with time slot 1 (transmitted by road side transmitter 1001) and receive data in three sections. The first section contains the coordinates of all vehicles within range of fixed transmitter 1001 for a particular direction of travel. The second section contains any emergency communications. The third section contains any general communications and advertisements. Vehicles 303, 304, 305, and 306 in range of transmitter 1001 receive the three sections, and each retransmits the three sections in Base+1 frequency and lowest time slot available at time of retransmission, but with only the first section changed, thereby providing transmitting vehicle coordinates and signal status if any. Fixed Transmitter/receiver 1001 filters receive only the first section, to compute and provide updated vehicle coordinates to all vehicles in its range.

Roadside-to-vehicle transmitter 1001 transmits in the base code (e.g., FDMA and TDMA) for the base frequency for the direction of vehicle travel, and receives in the base frequency plus a frequency increment of one. The range of transmitter 1001 for vehicle-to-vehicle communication is shown by the dotted circle in FIG. 13. Vehicles 302 through 311 are all travelling in the same direction, with vehicles 303 through 306 within the range of transmitter 1001. Vehicles 303 through 306 are forced tuned to the base frequency of the bandwidth used for vehicle-to-vehicle communication for the direction of travel, in order to receive information from transmitter 1001. Vehicles 303 through 306 retransmit information in the base frequency plus a frequency increment of one and varying time slot. All vehicles travelling in the direction of travel retransmit in relay manner, using the received frequency plus a frequency increment of one for retransmission.

When a mobile vehicular unit receives a transmission in a frequency other than the base frequency, the mobile vehicular unit checks whether the coordinate provided in the transmission indicates that the transmitting vehicle is directly ahead. If no vehicle is directly ahead, then the vehicle closest to the centerline of travel but falling within a 45-degree angle from the vehicle receiving the transmission is selected. For example, vehicles 308 and 309 are within a 45-degree angle of vehicle 311. The mobile vehicular unit then re-transmits the received transmission, with the coordinates contained within the first section of the transmission replaced with the coordinates of the re-transmitting vehicle. The second and third sections of the transmission are relay-transmitted without change.

Time-division multiplexing is used to accommodate vehicles in parallel to each other. For example, vehicles 308 and 309 are in parallel lanes. Both vehicles 308 and 309 scan for vehicle-to-vehicle transmission from a vehicle ahead of vehicles 308 and 309, by verifying coordination position.

Vehicles 308 and 309 receive the transmission from vehicle 307. If vehicle 308 is the first vehicle to receive the transmission, vehicle 308 will begin retransmission in the received frequency plus a frequency increment of one, with base TDMA being a default, after vehicle 308 checks to make sure no other transmission is available in range using the same received frequency plus a frequency increment of one. The second vehicle, 309, to receive the transmission from vehicle 307 will notice that a retransmission, from vehicle 308, in the received frequency plus a frequency increment of one, is already in broadcast within the range of vehicle 309 in the base time slot. Vehicle 309 then checks to see whether the next time slot is free, and if so, vehicle 309 broadcasts in the received frequency plus a frequency increment of one in the next time slot. If the next time slot is not free, then vehicle 309 broadcasts in the next available time slot.

In the absence of any reception either from a stationary transmitter of from a vehicle ahead in the direction of travel, the mobile vehicular unit of a vehicle will transmit in the base frequency plus a frequency increment of one, and the transmission will contain only the coordinates of the vehicle (the first of the three sections). For vehicle-to-vehicle communication, tuning for change in direction is time delayed to maintain the continuity of the relay path in instances of curves and deflections.

When a vehicle reaches an intersection with a general data transmission providing intersection details and approach road directions (as is described in FIG. 9), the vehicle-to-vehicle receiver scans for coordinates communications from these approach roads and computes progress of vehicles to assess any possibility of accident and to provide advance collision warning.

In particular, by computing the details of road intersections obtained from traffic control transmitters at junctions, as is described in FIG. 9, during approaches to traffic junctions, the vehicle-to-vehicle receiver can be made to scan the directional vehicle-to-vehicle communications for all approach roads to a junction. In this manner, the vehicle-to-vehicle receiver can obtain the first section of such vehicle-to-vehicle communications containing vehicle coordinate movement details of all vehicles approaching the junction. The progress of the vehicles approaching the junction is plotted in background for the purpose of assessing a probability of collision and providing an advance audio or video warning for collision prevention.

Figure 14:
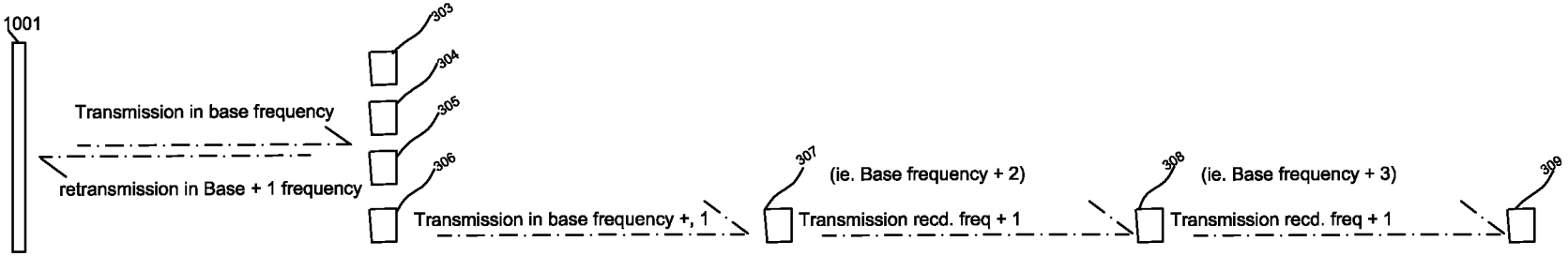
FIG. 14 is a diagrammatic representation of the vehicles of FIG. 13, illustrating direction-based relay-type vehicle-to-vehicle communication in accordance with the invention.

FIG. 14 Illustrates direction-based relay-type transmission and reception for vehicle-to-vehicle communication. Transmissions from transmitter 1001 contain, in section one, coordinates of all vehicles 303, 304, 305, and 306 in range, in section two, emergency communications, and, in section three, general communications. Transmission from transmitter 1001 is in the base frequency. Retransmissions from vehicles 303, 304, 305, and 306 are in the base frequency plus a frequency increment of one. The retransmissions contain, in the first section, the coordinates of the individual vehicle 303, 304, 305, or 306 performing the retransmission. The retransmissions also include the section two emergency communications, and the section three general communications. Transmitter/receiver 1001 ignores sections two and three of the retransmissions received from vehicles 303, 304, 305, and 306. Only the vehicle coordinates are filtered for reception by transmitter/receiver 1001 and retransmission from transmitter/receiver 1001 to all vehicles. Vehicle 306 retransmissions, in the base frequency plus a frequency increment of one, are also received by vehicle 307, because vehicle 306 is the vehicle being directly ahead or closest to being directly ahead of vehicle 307. Vehicle 307 retransmits in base frequency plus a frequency increment of two (i.e., the frequency of the transmission received by vehicle 307 from vehicle 306 plus a frequency increment of one), at the lowest time slot available, to be received by vehicle 308 behind vehicle 307, and the relay type transmission continues. In all cases only the first section of the transmission is replaced by each vehicle for retransmission, and the second and third sections are retransmitted unchanged. Transmission continues in relay manner to the last vehicle, in this case vehicle 312. If any of the transmissions indicates risk of a collision, a warning to the driver is initiated. Once the incremented frequency reaches the highest value in the bandwidth, retransmission will continue cyclically starting again from the base frequency plus a frequency increment of one.

We turn now to the type of transmissions provided by the transmitters described above, by means of a general multiplexed code to all vehicles in range of the respective transmitters.

The GPS error signal from a stationary receiver (DGPS) is transmitted to the vehicles for vehicle unit error correction. This GPS error signal is used by the vehicular unit to compute and establish the integrity of the GPS satellite signals (Differential GPS), and improve the accuracy of vehicle position. Where these signals are within range of vehicular units, or upon achieving full coverage, lane management and hard shoulder intrusion warning become possible.

The correction angle of magnetic north to true north for a particular locality is also transmitted, in order to ensure frequent continued correction for any slight drift, or due to time and geographical variation.

The transmitters also transmit the local emergency message number. In the event of an emergency the vehicular unit sends an emergency message (SMS) with vehicle details, and coordinates of the vehicle, to this emergency number, with an indication of nature of emergency, such as airbag activated, car toppled over, or manual emergency activated. The message is also sent to the emergency number of the place of vehicle registration. The local police control room on receipt of message can use the unique number provided in the message to call the vehicle. In particular, a program in the central control room, on receipt of the message at the emergency message number, immediately alerts an operator to the location of the vehicle and prompts the operator to make an emergency call to the number contained in the message.

The local traffic violation message number is transmitted to the vehicles. The vehicle forwards violations such as red signal crossing and speed violation to this number, twice per violation with a 5-second time gap. The message thus forwarded has vehicle details, heading direction, coordinates and time of violation, and nature of violations, including the speed limit of the area of the violation or the traffic signal status. All details of the violation remain intact between the two violation reports, except that coordinates are updated. Based on receipt of violation message the computer program in a control room verifies and reconfirms the validity of the violations and generates the fine, and forwards the violation to the registration office of the vehicle.

The transmitters also transmit the local traffic information number, for enabling messages to be communicated when vehicles are travelling below a specified speed within limits of a city or on highways that are marked by priority-coded wayside instruction that provide distance marked for survey. Also transmitted to the mobile vehicular units are the vehicle low-speed threshold for the sector, the duration the vehicle should remain below the speed to provide a feedback, and also the maximum number of messages a vehicle may send, from satellite transmitter mobile or fixed. The mobile vehicular unit sends a message containing only vehicle coordinates, under circumstances of a defined traffic jam, and the message will be with a prefix number 1 to N, where N is the maximum number of messages instructed to be sent by a vehicle. The computer program in the control room computes all such messages to identify and monitor progress of places having a traffic jam and to use the details to divert and manage traffic. Thus, traffic movements within city limits and highways are recreated, due to slow moving traffic, by mapping coordinates from messages received at the local traffic information or management number.

The local toll number and parking number may be transmitted by the transmitters in case of central control, of these numbers, or may be given by general transmission on entry to a toll road or parking area.

The transmitters also transmit a complete set of local statutory requirements that are put in a memory section, for recall and to be familiarized by passengers on demand. For example, the memory section contains statutory requirements concerning whether all passengers are required to use seat belts or only front passengers is mandatory.

Also transmitted is a complete matrix with addresses and coordinates of general transmission antennas, fixed satellite antennas, and directional antennas, within a particular city or within city limits, or within a 100 km radius if outside of a city. The mobile vehicular unit thus becomes aware of all antennas, with addresses of transmitters, that it can receive signals from. Any reception of signals from antennas other than those provided in the matrix are treated as spurious, and are discarded, and a message is sent to the local traffic information center indicating spurious reception, with only coordinates of the vehicle. The satellite transmitters not included in the matrix that are accommodated by the mobile vehicular units are those satellite transmitters requesting vehicle identity and requesting slow traffic information. But, a parallel message with coordinates of such requests received is transmitted by the mobile vehicular units to the local traffic information number.

All of the above data is refreshed with a new set of data, every time a vehicle approaches a transmission, in general code, i.e. DSCDMA0, and the new set of data is set to memory at the first instance of decrease of signal strength from the transmitter. Any change in local statutory requirements is identified by comparison with previous data in memory and replaced with a fresh set of data with an accompanying soft audible alert, announcing the change in local driving rules received. On request by passenger, the change is indicated.

The transmitters also transmit complete details of road intersections, identifying all the exits with destination and by angle measured from true north, and the signal lights relevant to each road of approach to the intersection with a unique tag for each traffic light. The details thus provided are computed by the mobile vehicular unit to identify its road of approach, the number of exits with the angle and destination of each of the exits, and traffic control lights relevant to each exit from its road of approach. This data is present only for the period when transmission is present, i.e. the vehicle is in range of the transmitter that transmits the road intersections.

Other data that can be transmitted by the transmitters includes real-time traffic information, weather information, etc.

By another general communication using a separate frequency and bandwidth, the transmitters transmit updated digital maps of locality traffic jurisdictions to the mobile vehicular units.

Having described the types of transmissions provided by means of a general multiplexed code to all vehicles in range of the respective transmitters, we now describe the types of transmissions provided by means of a unique multiplexed code, reception of which is distinguished by direction of vehicle travel.

The transmitters transmit the presence and status of signal lights that are relevant to the vehicle to which the transmission is communicated, together with the remaining time until the change in the traffic signal lights, and next status on expiry of time. This information is used by the in-vehicular computer unit to display traffic light present status, and expected status upon vehicle reaching intersection.

Along with a signal status, a unique password is transmitted, which will retain the signal status in the vehicle graphical unit for few seconds after the vehicle crosses the location of the traffic signal. In the absence of this password the signal status will be removed from the graphical screen about 25 meters before the signal crossing. The option is included for taking care of initial periods of implementation of the traffic management and control system, when visual lights are also available, and to ensure drivers are forced to look at the visible signal during this phase of implementation of the system. When integrity of the traffic management and control system is proved beyond any reasonable doubt and traffic control is possible even without visible lights, an addition of password along with transmission will ensure a seamless switch-over to in-vehicle traffic controls, with or without presence of visible traffic controls.

The transmitters also provide speed limits of the road ahead, which is set in memory at the first instance of decrease in signal strength observed and similarly refreshed and replaced with a new value every time new data is received. Also transmitted are traffic warnings, e.g., "school ahead," only for the duration the signal strength is increasing.

We turn now to transmissions by satellite transmitters/receiver in redundant that are installed across approach roads to traffic intersections or high road density areas, as is discussed above in connection with FIG. 7. The redundancy is used to regulate power levels in order to limit the transmission range to a little more than the width of road, to ensure the range of transmission is sufficient and sufficient only for the vehicles on the road, and not much further. Transmissions from such satellite transmitter/receivers in redundant are for assigning specific access codes, especially on approach road to intersection and traffic signals, and high road density areas. The satellite transmitter communicates a specific multiplex access code, base code or higher level, for the direction of travel of the vehicle. For example, if the vehicle is travelling true north with reception code DSCDMA1, the priority instruction may be any of these: DSCDMA1-0 to DSCDMA1-8, with the distance in meters the reception is to be followed, after completions of which the mobile vehicular unit will revert back to normal direction-based reception. Also in the case of an intersection having a traffic control signal, the distance in meters to the signal light crossing line, for signal junctions, is transmitted.

As is discussed above, the computer in the mobile vehicular unit, on receipt of the details, will set a temporary coordinate memory to zero and force it to remain at zero until the first decrement in signal strength from the satellite transmitter is observed. At this point the coordinates will be released for measurement based on vehicle travel, and a new multiplexing code as per instruction will be simultaneously set. The computer in the mobile vehicular unit then uses this data to identify when the vehicle crosses the location of the traffic control signal, and whether this was done at a time the signal was red, yellow, or green. In the event the crossing was done when the signal was red, then a red signal violation message is sent to the local traffic violation message number, complete with vehicle details, coordinates, and time of violation.

Turning now to traffic warning transmitters, these transmitters may use solar or conventional power to communicate in one directional channel based on road heading. Near a traffic signal intersection this communication will follow the assigned code.

We turn now to vehicle identification units with transmitter/receivers having number plate recognition cameras and software, either fixed in motor ways or mobile units in police car. These transmitters with directional antennas communicate a unique request in priority directional communication DSCDMA0X-9, and the vehicular unit on receipt of the request, will reply the following details back in another unique code, DSCDMA20, providing vehicle details, speed, the number of persons in the front seat not using seatbelts, the number of persons in the back seat not using seat belts, etc. The computer of the vehicle identification unit compares vehicle details received, with the number plate recognized by the recognition camera to verify both are the same. Variations in number plate and vehicle details received are alarmed as indicative of a possible fraud. Also, any violation of seatbelt rules as per local rules is alarmed for action. Lastly, transmitters installed in toll and parking entrances use directional communication in base mode DSCDMAX-0, or higher based on instruction, to broadcast a unique request for toll and another unique request for parking, that is confirmed by vehicles with time and vehicle prepaid card number, on exit of toll or parking. The toll or parking charges debited from the prepaid card for the vehicle are communicated to the mobile vehicular unit of the vehicle. The calculation of the charges may be based on fixed charges or mileage-based metering specific to a particular toll gate. Tolls and fees collected in this manner can include congestion pricing, electronic road pricing, fee-based express or high-occupancy-vehicle lanes, vehicle-miles-traveled usage fees, and variable parking fees. Also, the transmitter in a parking lot may provide coordinates of available parking spaces to vehicles upon entry of the vehicles to the parking lot, and after the vehicle has occupied and then exited the parking space, the vehicle may confirm exiting the space, for charge collection. Parking management is therefore aware in real time of available and used parking spaces.

Figure 15:
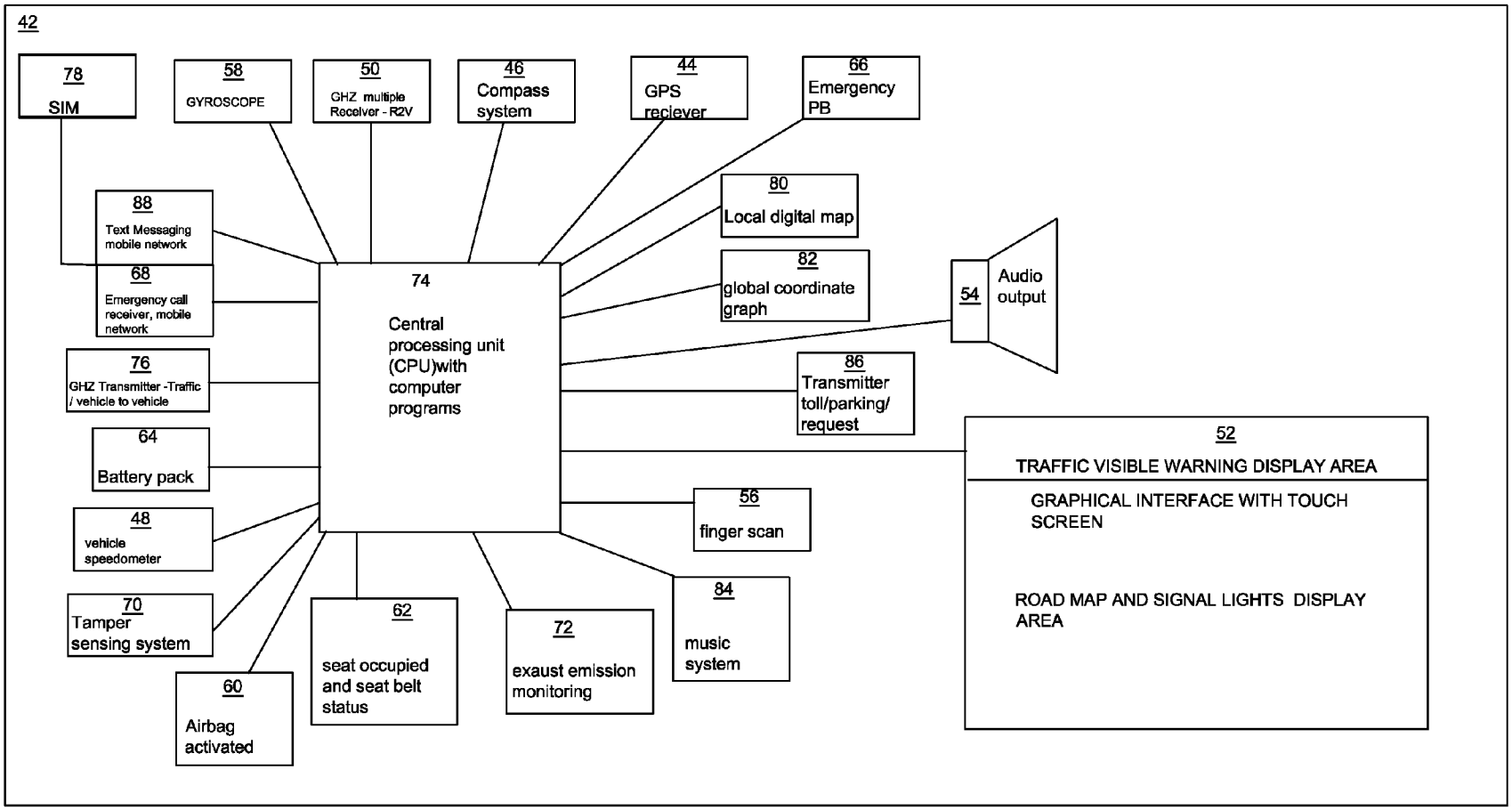
FIG. 15 is a block diagram showing certain details of a mobile vehicular unit in accordance with the invention.

With reference to FIG. 15, there is shown certain details of a mobile vehicular unit 42 employed in accordance with the invention. The mobile vehicular unit uses GHZ communication for traffic control purposes, and GSM or its equivalent for critical feedback purpose. The method takes advantage of wide established coverage of the mobile network and obtains wide feedback coverage, at the same time limiting any intrusion on privacy, as vehicle details broadcast are limited to instances of traffic violations. Thus, since feedback from the mobile vehicular unit is by message, and limited to the time of violation, privacy is not compromised, while at the same time wide coverage is provided to improve accountability.

While it is essential to install a communication transmitter/receiver where specific controls are required, at this juncture it is difficult and unnecessary to extend such coverage to an entire road network (requiring a transmitter every 350 meters), and so until such a time the coverage is well established, the best practical and economical solution is to install communication transmitter/receivers at essential locations.

The mobile vehicular unit is designed bearing in mind high availability of critical functions and universal adaptability. All components critical to ensure stable functions of the unit are redundant.

Direction of travel is a critical requirement for ensuring stable and accurate functioning. Therefore, two independent methods are used by the vehicular unit for comparison and back-up: First, GPS coordinate movements from a GPS system 44 are traced to establish direction. The mobile vehicular unit has the program resources to identify travel direction and to compute its angular deviation even in the absence of a local map (a digital map 80 of the local area in a memory chip). Also, the mobile vehicular unit includes an accurate compass system 46, consisting of three or more compasses, including accurate digital fluxgate compasses and at least one FOG compass with less than one minute settling time. This compass system will back up the directional based tuning requirements in the absence of availability of GPS 44. The GPS direction, when available, gives frequent correction details to correct for any error in compass system 46.

Another high availability critical function is vehicle speed, which is calculated from coordinate movement and also from input from a speedometer 48. During loss of GPS or loss of integrity of the GPS signal, the vehicle will continue to compute the coordinates of the vehicle, from vehicle speed, compass and gyroscope, until the GPS is re-established and any error in vehicle coordinates is corrected.

Mobile vehicular unit 42 also includes a communication receiver 50 that is tuned to receive the following multiplexed signals for traffic instruction from a road-side stationary transmission system, at any given time: the general multiplexed communication base channel DSCDMA0, and also, based on the direction of vehicle travel, the vehicle unit is automatically tuned to two DSCDMA code numbers assigned to the segment of travel of the vehicle. For example, if the vehicle is travelling true north which is standardized as zero degrees, then the unit will tune to DSCDNA01-0 (the base code) and DSCDMA01-9 (the priority code). The base code may be substituted by priority code instruction for a limited defined distance.

The function of the priority coded communication with suffix –09, in any direction, is to temporarily override directional tuning reception (base code) by code of its instruction, for a predetermined distance also specified in the instruction. The communication instructs the DSCDMA code for receipt of information by the vehicle unit, for the next defined distance in meters, after which the mobile vehicular unit reverts back to the base code corresponding to the direction of the vehicle. This assignment of priority coded communication is for anchoring reception on approach to traffic lights, during temporary deviations and difficult geographical terrains, and for additional filtering to avoid signal overlap in dense signal areas.

The priority coded communication is also used by authorities by means of trans-receivers from roadside or police vehicle to request a feedback to check for vehicle fraud and local rule compliance and to mark high-traffic density roads for congestion feedback.

Communication receiver 50 is also programmed to receive, based on direction, one forward channel for vehicle-to-vehicle communication using a frequency and bandwidth different from the frequency and bandwidth used for communication between stationary transmitters and the vehicle. As is described above, the vehicles are programmed to transmit in a relay manner, after incrementing frequency by one level from frequency of reception. Accordingly, the mobile vehicular unit is provided with a transmission system 76 for vehicle-to-vehicle communication, as well as for communication with roadside transmitters.

GPS positioning system 44 identifies the direction of the vehicle, which is used by mobile vehicular unit to tune directional receiver 50 to receive traffic details specific to the direction of travel of the vehicle. A memory outlay of world coordinates 82 traces the vehicle movement and identifies vehicle travel direction, so that the mobile vehicular unit is capable of computing the coordinates of travel and establishing the direction of travel even in the event a digitized map of the local area 80 is unavailable or vehicle coordinates fall outside the available map. High-availability 3-compass system 46, having multiple digital compasses including fluxgate compasses and a fiber-optic gyro compass with very low settling time, with GPS input for developing periodic correction details to improve accuracy by auto-self-correction, serves as a back-up to GPS direction, for eventualities or loss of GPS signal.

Two-section graphical interface system 52 displays necessary traffic control and warnings, and also serves as a touch screen to input information to the mobile vehicular unit. An audio system 54 warns of traffic controls, speed limits, and violations, and also serves as an output for music system 84. Finger scan system 56 is provided for authorized access and theft control. Gyro 58 senses vehicle rollover or tumbling, and initiates an emergency message to a local emergency message center with vehicle coordinates and a vehicle unique emergency call number, by use of which traffic authorities can call or page the vehicle. Feedbacks from airbag activation detector 60 are also provided to initiate an emergency message of the type described above. Feedbacks from a seat belt status detector 62 are also provided for local rule compliance. Feedback from the speedometer 48 is compared with coordinate shift and used as a backup system for monitoring speed limits and speed violations. Feedback from a vehicle exhaust gas monitoring system 72 is also provided for environment safety and control. An emergency activation push button 66 that is not easy to activate is provided for manual initiation of an emergency message.

A mobile communication system permits communication by means of emergency SIM, GSM/CDMA/Satellite, mainly for messaging through text messaging sub-system 88 and two-way communications through emergency call receiver/transmitter 68, in event of emergency, with an emergency control room only. The mobile communication system can function as a sealed and tamper-proof integrated mobile telephone capable of using any mobile coverage available, to send and receive messages and to receive emergency calls. Vehicle unit 42 includes a unit tampering identification system 70 to provide a tamper-proof activation signal if the emergency SIM or the unit is tampered with. The activation signal initiates frequent messages, if within mobile range, and writes to non-volatile memory, resettable only by authorities, for making messages when in the mobile coverage area. Such messages written in non-volatile memory can be erased only by a vehicle licensing authority. An inbuilt battery pack 64 ensures power to write and message in the event power from vehicle is removed. Power outages with duration are written to memory. Any tampering attempted in a non-signal area is written to non-volatile memory, resettable only by traffic department. Furthermore, any message in this memory initiates messages with vehicle details and coordinates, in frequent intervals, when a mobile coverage is detected. Similarly, any speed violation in an area without mobile coverage is put in queue for message, and a message is sent once the vehicle reaches an area with coverage.

For purposes of stolen vehicle tracking, a coded request message by GSM or its equivalent is sent to a unique vehicle ID only from the traffic control room of the place of vehicle registration. This coded request message directs the mobile vehicular unit to periodically initiate a message, to a licensing office message number predefined in the SIM card of the mobile vehicular unit, the message containing vehicle number and vehicle details and coordinates of the vehicle until a reset message is sent from the same traffic control room. The mobile vehicular unit is programmed to receive this code only from the place of registration of the vehicle, whose number is programmed to the vehicle SIM unit 78 at the time of registration or renewal of the vehicle.

Besides the normal GPS functions, the mobile vehicular unit is controlled by a central processing unit 74 having a computer program to collect and organize all of the data received by the mobile vehicular unit by wireless communication and all of the inputs from all integral functional units of the mobile vehicular units, and to perform all of the tasks described in detail below. For example, a computer program in the mobile vehicular unit causes the mobile vehicular unit to receive control instructions, tune to receive directional instruction based on the directional of travel of the vehicle, or as instructed by priority communication, and thereby receive all relevant instruction and information for its travel, compute the received details to reproduce the traffic controls and warnings, identify emergency conditions, initiate emergency messages, identify traffic blocks in city limits and high ways and message this information to a central control room, identify toll gates and parking areas, and monitor and message vehicle traffic violations to local traffic violation message center numbers.

In particular, the mobile vehicular unit monitors the vehicle direction by GPS coordinate movement and compass direction, monitors for any variations of both signals, monitors for variation in each of the three compass signals, and corrects for any error at regular intervals, when healthy GPS based direction is available. Based on direction so established from the GPS and/or compass, the mobile vehicular unit is programmed to tune the directions frequency receiver to receive base and priority directional multiplexed signals for its direction of travel.

The mobile vehicular unit also receives the general communication data, and sets it to a memory location assigned to it, to compute the transmission antenna data and make a map of it in memory for verification of possible spurious transmission and any missing transmission.

Another task performed by the mobile vehicular unit is to compute intersection details received, compute the vehicle approach to the intersection, and create a map showing angle of exits with destination of all exits from the road of vehicle approach. The mobile vehicular unit also receives, over priory directional multiplexed code, the reception code for the next so many defined meters (for example, DSCDMA02-7 for 342 meters), and then to change the vehicle unit reception code from base code for the direction to DSCDMA02-7 for the next 342 meters, counted by an odometer set to 0.00 at the time the priority code instruction is set. The mobile vehicular unit receives, over priority directional multiplexed code, the distance to signal crossing, and monitors the distance at which the signal line is crossed and generates a message to local traffic violation number, if a crossing took place when the signal status is red.

The message is sent twice with a five-second delay, and includes vehicle direction, the time of violation and the vehicle details, plus coordinates and time stamp at time of each message.

The mobile vehicular unit is programmed to receive and set to assigned memory, the speed limit of an area, compare the speed limit with the vehicle speed for violation with respect to percentage and time to allow some variation for overtaking, etc., warn the driver of the vehicle by providing audio and video warning of speed exceeding the local limit, and, when a defined grace speed, time, and warning are exceeded, send two speed violation messages on a real-time basis within a span of five seconds to a local traffic violation message center number with vehicle registration details, road speed limit and vehicle speed, direction of travel speed of the vehicle, time stamp of the violation, and coordinates of vehicle at the time of generating the message. The speed limit is refreshed and set to memory every time a speed limit transmitter comes in range.

Another task performed by the mobile vehicular unit is to receive the traffic signal status and pass code, if any, for a traffic intersection by means of an assigned multiplexed code, by general directional transmitter, to display the signals status of all exits from the vehicle road of approach, and to compute the signals status upon the vehicle reaching the intersection. In the event of the absence of a pass code, the signal status is removed from graphical details before the vehicle reaches 25 meters from the traffic signal position, in order to ensure that the drivers of vehicles look at actual traffic signals rather than rely solely on the mobile vehicular unit, as is explained above. In the event that a pass code is present, however, the in-vehicle traffic status display will continue to be remaining until the vehicle crosses the intersection.

At the entry to a toll or parking lot, a fixed transmitter sends a request, and upon receipt of the request over directional base code, the vehicle details and a code number to parking or road toll system are transmitted by the mobile vehicular unit in GHZ, by means of GHZ transmitter 86, and on exit the charge is calculated and the amount debited is confirmed by the mobile vehicular unit.

On receipt of a unique request over priority directional communication, a reply by GHZ communication is provided by GHZ transmitter 86 of the mobile vehicular unit giving the vehicle details, and seats in vehicle that are used without seat belts. This information is processed to avoid vehicle identity fraud (use of false number plates), to ensure compliance with regard to seatbelt laws, etc. When an emergency is detected, such as vehicle tumbling detected by gyroscope, or airbag activation, the mobile vehicular unit sends an emergency message to a local emergency number and the emergency number of vehicle origin, with vehicle details, vehicle coordinates, type of emergency, and call number. A call to this number is picked up by the mobile vehicular unit and paged for occupants of the vehicle to hear and speak if possible.

Any tampering with the mobile vehicular unit will immediately start initiating messages to a traffic violation number of the place of registration of the vehicle in frequent intervals until the mobile vehicular unit is reset by a traffic control room. These messages include vehicle coordinates. If the tampering is done in a place of no mobile network coverage, this information is written to a non-volatile memory and messaged when coverage is detected. Also, an optional finger scan capability is provided for authorization set with password, thereby making it possible for an authorized person to assign rights for a predetermined time to others, possible by consecutive scanning of the authorized person and the assigned person with a time limit after setting the duration.

The mobile vehicular unit is programmed for vehicle-to-vehicle normal communication using directional communication, by means of GHZ transmitter 76, in a frequency and bandwidth different from the frequency and bandwidth used for transmission from transmitters to the mobile vehicular unit. The total bandwidth is divided into n number of directional sectors, as used in roadside to in-vehicle communication, for, e.g., 16 directional sectors, and each directional sector is assigned one of the 16 bandwidths. The lowest frequency of each of these sectors is transmitted in TDMA slot 1 (time division multiplexing) and is called the base frequency. As is described above, only road side transmitter/receivers conveying messages intended for vehicle-to-vehicle communication transmit in this base frequency. Whenever any vehicle is within base transmitter range, each of the vehicles receives only communication from the road-side transmitter. The communication from the fixed road-side transmitter is in three sections: the first section containing vehicle coordinates and any signal status, the second section containing emergency messages, and the third section being a general section.

The mobile in-vehicle unit, outside the base transmission range and in presence of vehicle-to-vehicle transmission from another vehicle, is programmed to check the coordinates received to be ahead and within a 45 degree angle on either side as indicated in FIG. 11. If more than one transmission is present, based on coordinates sampled the one closest to directly ahead, i.e., a straight line, is selected. During lane switching the channels therefore switch.

As is explained above, for retransmission each mobile vehicular unit transmits in the lowest available time slot with a frequency one level higher than its frequency of reception. In the event the frequency and time slot is already in use in range of the vehicle, it will jump to the second available time slot, and so on. The fixed transmitter-receiver collects only the first of the three sections from each vehicle in its range and computes to update the coordinates of the vehicle in its transmissions.

Each re-transmitting vehicle replaces the first section with the coordinates of the re-transmitting vehicle, and relays the second and third sections intact. In the absence of any reception the mobile vehicular unit transmits in base frequency plus a frequency increment of one and containing only the first of the three sections.

The mobile vehicular unit is also programmed for emergency vehicle paging. Emergency vehicles will be equipped with a transmitter that transmits in multiplexed code for the direction of travel of the emergency vehicle. This transmitter transmits the emergency code for recognition followed by vehicle coordinates. A pass code in the multiplexed code transmitted by the emergency vehicle specifically denotes emergency vehicle approach. A mobile vehicular unit of a vehicle travelling in the same direction receives and verifies the code, checks its coordinates to verify the emergency vehicle is behind the vehicle containing the mobile vehicular unit, and generates an audio alarm to indicate that the emergency vehicle is approaching from behind.

At intersections, by use of a GPS destination set and/or details of approach roads transmitted by general transmission as described in connection with FIG. 9, the emergency vehicle extends the message transmission to all multiplexed codes for all directions of road approach to provide warning and unhindered passage of the emergency vehicle.

There has been described an advanced vehicle traffic management and control system and method. The system and method described above is set forth for illustration purposes, and may be varied based on statutory or other requirements, or for improved performance during detailed design, testing, or implementation. Accordingly, it is not intended that the invention be limited to the details set forth above, but only by the appended claims.

What is claimed is:

1. A system for intelligent transport communication, comprising:

at least one transmitter; and at least one in-vehicle mobile receiver for use within a mobile road vehicle;

wherein the at least one transmitter is programmed to broadcast simultaneously, by wireless communication, a plurality of different sets of dedicated data for each of a corresponding plurality of heading directions of the mobile road vehicle, on a corresponding plurality of multiplexed channels; and the receiver is programmed to tune selectively to one of the multiplexed channels that corresponds to an actual heading direction of the mobile road vehicle, and to receive the dedicated data on the one of the multiplexed channels that corresponds to the actual heading direction of the mobile road vehicle.

2. The system of claim 1 wherein the transmitter is programmed to communicate with the receiver, and the receiver is programmed to receive communications from the transmitter, by spread-spectrum short-range wireless communication.

3. The system of claim 1 wherein the plurality of multiplexed channels corresponds to 360 degrees of vehicle heading directions sectionalized in a standardized manner into multiple discrete sectors, each of which has a unique one of the pre-assigned multiplexed access codes.

4. The system of claim 1 wherein the dedicated data includes speed limit and traffic warnings.

5. The system of claim 1 wherein the dedicated data includes data indicating a status of a traffic signal light.

6. The system of claim 1 wherein the transmitter is programmed to broadcast, by wireless communication, general non-dedicated data on an additional multiplexed channel for reception by any mobile road vehicle within range of the transmitter regardless of heading direction of the mobile road vehicle.

7. The system of claim 6 wherein the general non-dedicated data includes a local message number for local emergency or violation reporting.

8. The system of claim 6 wherein the general non-dedicated data includes details of junctions and intersections.

9. The system of claim 1, wherein the receiver is also programmed to receive other dedicated data on at least one secondary multiplexed channel for the at least one of the heading directions, and to receive general non-dedicated data on an additional multiplexed channel for reception regardless of heading direction of the mobile road vehicle.

10. The system of claim 1, wherein the at least one transmitter includes at least one low-range satellite transmitter, and the low-range satellite transmitter is programmed to broadcast, by wireless communication, dedicated instructions on a priority channel for at least one of the heading directions of the mobile road vehicle, the dedicated instructions instructing the receiver to receive other dedicated data on a secondary multiplexed channel for the at least one of the heading directions, the low-range satellite transmitter also being programmed to broadcast the other dedicated data on the at least one secondary multiplexed channel for the at least one of the heading directions.

11. The system of claim 1, wherein the receiver is programmed to receive, under ordinary conditions, the dedicated data on the one of the multiplexed channels that corresponds to an actual heading direction of the mobile road vehicle, and to receive, upon instruction, other dedicated data on a secondary multiplexed channel for the at least one of the heading directions.

12. The system of claim 11 wherein the receiver is programmed to receive the dedicated data on the secondary multiplexed channel in a high road density area, during approach of the mobile road vehicle to a traffic control light, and during a temporary period of traffic management by a local authority.

13. The system of claim 1 wherein the at least one transmitter comprises a plurality of transmitters each of which is programmed to broadcast a set of dedicated data for a corresponding heading direction of the mobile road vehicle on a corresponding one of the multiplexed channels.

14. A multiple-redundant vehicle heading direction identification system, comprising:

a GPS direction identification system for use within a mobile road vehicle; and a multiple digital compass system for use within the mobile road vehicle programmed to identify a heading direction of the mobile road vehicle based on input from multiple digital compasses; and a central processing unit programmed to select the heading direction produced by the GPS direction identification system when an output of the GPS direction identification system is healthy during travel of the mobile road vehicle, and to select the heading direction produced by the multiple digital compass system when an output of the GPS direction identification system lacks signal integrity during travel of the mobile road vehicle.

15. An integrated multifunction unit for intelligent transport communication, for use within a mobile road vehicle, comprising:

a receiver capable of multiple channel reception, for receiving road-side-to-vehicle wireless communications from at least one road-side transmitter on one of a plurality of multiplexed channels having a corresponding plurality of different sets of simultaneously broadcast dedicated data for each of a corresponding plurality of heading directions of the mobile road vehicle;

a vehicle heading direction identification system; and a central processing unit programmed to cause the receiver to tune selectively to at least one of the multiplexed channels that corresponds to an actual heading direction of the mobile road vehicle, and to receive dedicated data on the at least one of the multiplexed channels, the at least one of the multiplexed channels corresponding to the actual heading direction of the mobile road vehicle.

16. The integrated multifunction unit of claim 15 further comprising a mobile communication system for use within the mobile road vehicle to send and receive messages to and from the mobile road vehicle, a gyro for detecting roll-over of the mobile road vehicle, and a vehicle airbag activation detector, and wherein the central processing unit is programmed to cause the mobile communication system to send an emergency message in response to detection of a roll-over by the gyro and in response to detection of airbag activation by the airbag activation detector, the emergency message including vehicle coordinates and a vehicle unique emergency call number, by use of which traffic authorities can call or page the mobile road vehicle.

17. The integrated multifunction unit of claim 15 further comprising a mobile communication system for use within the mobile road vehicle to send and receive messages to and from the mobile road vehicle, and wherein the central processing unit is programmed to cause the mobile communication system to transmit real-time traffic management reports and real-time traffic violation reports to a local traffic authority in order to enable centralized traffic management.

18. The integrated multifunction unit of claim 15 further comprising:

a speedometer, and a mobile communication system;

wherein the central processing unit is programmed to compare a speed limit received from a road-side transmitter with a speed received from the speedometer and to provide a warning to a driver of the mobile road vehicle that a speed of the mobile road vehicle exceeds the speed limit, and to cause the mobile communication system to send a message to a traffic violation center on a real-time basis when the speed of the vehicle exceeds the speed limit by a defined grace speed for a defined time.

19. The integrated multifunction unit of claim 15, wherein the central processing unit is programmed to cause a status of traffic signal lights or ramp meters to be indicated to a driver of the mobile road vehicle in response to data received from the road-side transmitter.

20. The integrated multifunction unit of claim 15, wherein the dedicated data includes data indicating a status of a traffic signal light, the integrated multifunction unit further comprising a mobile communication system for use within the mobile road vehicle, and wherein the central processing unit is programmed to cause the mobile communication system to send a message to a traffic violation center when the mobile road vehicle crosses a red traffic signal light.

21. The integrated multifunction unit of claim 15, further comprising an in-vehicle transmitter programmed for communication with the receiver of an integrated multifunction unit of a second mobile road vehicle, the in-vehicle transmitter being programmed to transmit using a frequency and bandwidth different from a frequency and bandwidth used by the road-side transmitter.

22. The integrated multifunction unit of claim 15, further comprising an in-vehicle transmitter programmed for communication with the receiver of an integrated multifunction unit of a second mobile road vehicle, the in-vehicle transmitter being programmed to transmit a message containing coordinates of the first mobile road vehicle to the second mobile vehicle.

23. The integrated multifunction unit of claim 15, wherein the receiver is programmed to receive a communication from an in-vehicle transmitter of an integrated multifunction unit of a second mobile road vehicle, and the receiver is programmed to verify that the second mobile road vehicle is located ahead by verifying coordinates of the second mobile road vehicle included in the communication from the in-vehicle transmitter of the second mobile road vehicle.

24. The integrated multifunction unit of claim 15 wherein the central processing unit is programmed to cause the receiver to scan for vehicle-to-vehicle transmissions from mobile road vehicles on approach roads to an intersection, based on intersection details received by the receiver from the road-side transmitter, to plot coordinates of mobile road vehicles on approach roads, to compute possibility of collision, and to provide a warning to a driver of the mobile road vehicle based on the possibility of collision.

25. An integrated multifunction unit, further for use within a first mobile road vehicle, comprising:

a receiver;

a central processing unit; and an in-vehicle transmitter programmed for communication with the receiver of an integrated multifunction unit of a second mobile road vehicle, the in-vehicle transmitter being programmed to re-transmit, in relay fashion, a message received by the receiver of the first mobile road vehicle from a transmitter of an integrated multifunction unit of a third mobile road vehicle;

the central processing unit being programmed to cause the message transmitted in relay fashion to be transmitted in a lowest available time slot for retransmission, in a frequency of the message received from the third mobile road vehicle plus a frequency increment of one.

26. An integrated multifunction unit for intelligent transport communication, for use within a mobile road vehicle, comprising:

a subscriber identity module for use within the mobile road vehicle;

a mobile communication system, for use within the mobile road vehicle, for receiving a coded message from a vehicle registering authority; and for sending intermittent messages to a licensing office number identified in the subscriber identity module;

a central processing unit, for use within the mobile road vehicle, programmed to cause the subscriber identity module, in response to receipt by the subscriber identity module of a coded message from the vehicle registering authority, to send the intermittent messages to the licensing office number identified in the subscriber identity module;

the intermittent messages containing vehicle coordinates and vehicle details based on information in the subscriber identity module.

* * * * *